US006155670A

United States Patent [19]

Weber et al.

[11] Patent Number: 6,155,670

[45] **Date of Patent: *Dec. 5, 2000**

[54] METHOD AND APPARATUS FOR IMPROVED INK-DROP DISTRIBUTION IN INKJET PRINTING

[75] Inventors: Timothy L. Weber, Corvallis; John P. Harmon, Albany, both of Oreg.; S. Dana Seccombe, Foster City, Calif.; Colin C. Davis, Corvallis, Oreg.; Paul J. McClellan, Salem, Oreg.; David J. Waller, Corvallis, Oreg.

[73] Assignee: Hewlett-Packard Company, Palo Alto, Calif.

[ * ] Notice: This patent is subject to a terminal disclaimer.

[21] Appl. No.: 09/240,286

[22] Filed: Jan. 29, 1999

Related U.S. Application Data

[63] Continuation-in-part of application No. 08/812,385, Mar. 5, 1997.

[51] Int. Cl.[7] ..... B41J 2/21; B41J 2/145; B41J 2/15; B41J 2/02

[52] U.S. Cl. ..... 347/43; 347/40; 347/75

[58] Field of Search ..... 347/43, 20, 9, 347/56, 40, 48, 65, 75

[56] References Cited

U.S. PATENT DOCUMENTS

| | | | |
|---|---|---|---|
| 4,396,924 | 8/1983 | Rosenstock | 346/140 R |
| 4,468,679 | 8/1984 | Suga et al. | 346/140 R |
| 4,550,326 | 10/1985 | Allen et al. | 346/140 R |
| 4,621,273 | 11/1986 | Anderson | 346/140 R |
| 4,631,548 | 12/1986 | Milbrandt | 346/1.1 |
| 4,914,451 | 4/1990 | Morris et al. | 346/1.1 |
| 4,967,203 | 10/1990 | Doan et al. | 346/1.1 |
| 4,967,208 | 10/1990 | Childers | 346/140 R |
| 4,999,646 | 3/1991 | Trask | 346/11 |
| 5,196,056 | 3/1993 | Parsad | 106/15.05 |
| 5,258,774 | 11/1993 | Rogers | 346/1.1 |
| 5,369,428 | 11/1994 | Maze et al. | 347/5 |
| 5,422,666 | 6/1995 | Koyama | 347/41 |
| 5,485,180 | 1/1996 | Askeland et al. | 347/15 |
| 5,541,625 | 7/1996 | Holstun et al. | 347/5 |
| 5,583,550 | 12/1996 | Hickman et al. | 347/41 |
| 5,731,827 | 3/1998 | Mantell et al. | 347/40 |
| 5,764,256 | 6/1998 | Zhang | 347/71 |

FOREIGN PATENT DOCUMENTS

| | | | |
|---|---|---|---|
| 0517519A2 | 12/1992 | European Pat. Off. | B41J 2/205 |
| 0627314A2 | 12/1994 | European Pat. Off. | B41J 2/14 |
| 0730961A1 | 9/1996 | European Pat. Off. | B41J 2/05 |
| 0767061A2 | 4/1997 | European Pat. Off. | B41J 2/14 |
| 01014340 | 8/1990 | Japan | B41J 2/05 |

OTHER PUBLICATIONS

Donald J. Palmer et al, "Ink and Media Development for the HP PaintJet Printer", Hewlett–Packard Journal, Aug. 1988, pp. 45–50.

David L. Lee et al, "Engineering an Ink Jet Paper What's Involved?" Ink and Substrates, chapter 5, pp. 247–253.

J. Borch, "Plain Paper Choices for Ink Jet Printing", Ink and Substrates, chapter 5, pp. 288–292.

Enrico Manini, "Bubble Ink–Jet Technology with Improved Performance", Thermal Ink Jet, Chapter 4, pp. 177–178.

William J. Lloyd, et al., "Ink Jet Printing", Output Hardcopy Devices, 1988, Chapter 13, pp. 311–370.

*Primary Examiner*—Thinh Nguyen

*Attorney, Agent, or Firm*—Raymond A. Jenski

[57] ABSTRACT

A method and apparatus for improving inkjet print quality uses a printhead having an array using a plurality of nozzles in sets in each drop generator mechanism. Where a conventional inkjet pen fires a single droplet of ink at a target pixel per firing cycle, the present invention simultaneously ejects a plurality of droplets at different subdivisions of pixels. Drop generators of a printhead array includes a plurality of nozzles for the drop generators arranged such that the light absorption of the sum of the simultaneously ejected ink droplets is like that of conventionally ejected drops but distributed over an area of the printed medium greater than that of a conventional target pixel.

47 Claims, 14 Drawing Sheets

(1 of 14 Drawing Sheet(s) Filed in Color)

10x magnification
FIG. 10A 300 dpi placement (prior art)
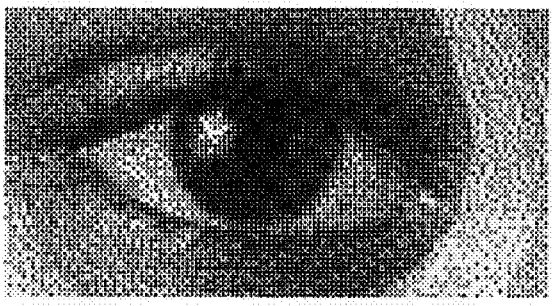
FIG. 10B 600 dpi placement (prior art)
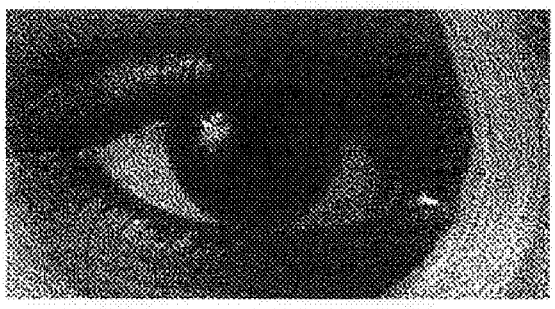
FIG. 10C CMYK R-RotQuad 300 dpi placement
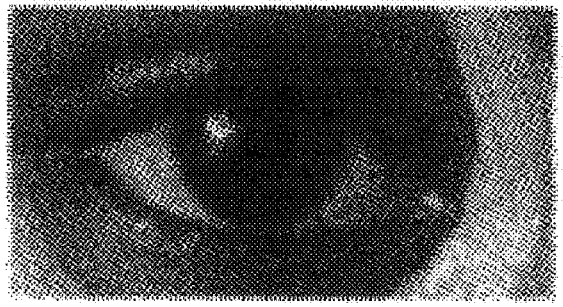
FIG. 10D C L-, MYK R-RotQuad 300 dpi placement
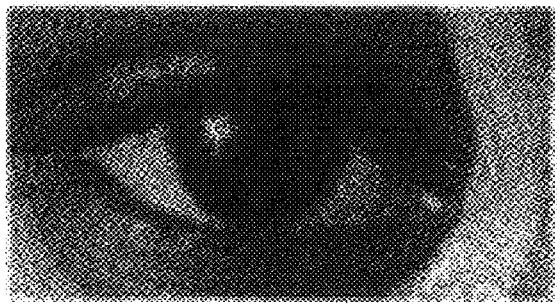

METHOD AND APPARATUS FOR IMPROVED INK-DROP DISTRIBUTION IN INKJET PRINTING

This patent is a continuation-in-part of U.S. patent application Ser. No. 08/812,385, "Method And Apparatus For Improved Ink-Drop Distribution In Inkjet Printing", filed on behalf of Weber et al. on Mar. 5, 1997, and assigned to the assignee of the present invention.

BACKGROUND OF THE INVENTION

1. Field of the Invention

The present invention relates generally to methods and apparatus for reproducing images and alphanumeric characters, more particularly to inkjet hard copy apparatus and, more specifically to a thermal inkjet, multi-nozzle drop generator, printhead construct and its method of operation.

2. Description of Related Art

The art of inkjet hard copy technology is relatively well developed. Commercial products such as computer printers, graphics plotters, copiers, and facsimile machines employ inkjet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices are also described by W. J. Lloyd and H. T. Taub in *Output Hardcopy Devices*, chapter 13 (Ed. R. C. Durbeck and S. Sherr, Academic Press, San Diego, 1988).

It has been estimated that the human visual system can distinguish ten million colors. Printing systems use a small subset of colors, yet can create acceptable reproductions of original images. Generally speaking, this is achieved by mixing the primary colors (red, blue green—additive; or cyan, magenta, yellow—subtractive) in sufficiently small quanta and exploiting tristimulus response idiosyncrasies of the human visual system. Effective use of these small quanta can be achieved in dot matrix color printing by varying the density or area fill, or both, to recreate each color or a reasonable semblance thereof in the image.

The quality of a printed image has many aspects. When the printed matter is an image, that is, a reproduction of an original image (that is to say, a photograph or graphic design rather than merely text printing), it is the goal of an imaging system is to accurately reproduce the appearance of the original. To achieve this goal, the system must accurately reproduce both the perceived colors (hues) and the perceived relative luminance ratios (tones) of the original. Human visual perception quickly adjusts to wide variations in luminance levels, from dark shadows to bright highlights. Between these extremes, perception tends toward an expectation of smooth transitions in luminance. Printing devices and similar imaging systems generally create an output that reflects light to provide a visually observable image. Exceptions such as transparencies exist, of course, but for consistency, the term reflectance will be used to denote the optical brightness of the printed output from a printing device. Generally speaking, reflectance is a ratio of the light reflected from a surface to that incident upon it. The colorants deposited upon the medium by inkjet printers are usually considered to be absorbers of particular wavelengths of light energy. This selective absorption prevents selected wavelengths of the light energy incident upon the medium from reflecting from the medium and is perceived by humans as color. Imaging systems have yet to achieve complete and faithful reproduction of the full dynamic range and perception continuity of the human visual system. While the goal is to achieve true photographic image quality reproduction, imaging systems' dynamic range printing capabilities are limited by the sensitivity and saturation level limitations inherent to the recording mechanism. The effective dynamic range can be extended somewhat by utilizing a non-linear conversion that allows some shadow and highlight detail to remain.

In inkjet technology, which uses dot matrix manipulation to form both images and alphanumeric characters, the colors and tone of a printed image are modulated by the presence or absence of drops of ink deposited on the print medium at each target picture element (known as a "pixel") generally represented as a superimposed rectangular grid overlay of the image. The medium reflectance continuity—tonal transitions within the recorded image on the medium—is especially affected by the inherent quantization effects of using ink drops and dot matrix imaging. These effects can appear as a contouring in printed images where the original image had smooth transitions. Moreover the imaging system can introduce random or systematic reflectance fluctuations (graininess—the visual recognition of individual or clusters of dots with the naked eye).

Perceived quantization effects which detract from print quality can be reduced by decreasing the density quanta at each pixel location in the imaging system and by utilizing techniques that exploit the psycho-physical characteristics of the human visual system to minimize the human perception of the quantization effects. It has been estimated that the unaided human visual system will perceive individual dots until they have been reduced to less than or equal to approximately twenty to twenty-five microns in diameter in the printed image. Therefore, undesirable quantization effects of the dot matrix printing method are reduced in the current state of the art by decreasing the size of each drop and printing at a high resolution; that is, a 1200 dots per inch ("dpi") printed image looks better to the eye than a 600 dpi image which in turn improves upon 300 dpi, etc. Additionally, undesired quantization effect can be reduced by utilizing more pen colors with varying densities of color (e.g., two cyan ink print cartridges, each containing a different dye load (the ratio of dye to solvent in the chemical composition of the ink) or containing different types of chemical colorants, dye-based or pigment-based).

To reduce quantization noise effects, print quality also can be enhanced by firing multiple drops of the same color or color formulation at each pixel resulting in more "levels" per color and reducing quantization noise. Such methods are discussed in U.S. Pat. No. 4,967,203 to Alpha N. Doan et al. for an "Interlace Printing Process", U.S. Pat. No. 4,999,646 to Jeffrey L. Trask for a "Method for Enhancing the Uniformity and Consistency of Dot Formation Produced by Color Ink Jet Printing", and U.S. Pat. No. 5,583,550 to Mark S. Hickman et al. for "Ink Drop Placement for Improved Imaging" (each assigned to the assignee of the present invention).

One can also reduce graininess in a picture by essentially low pass filtering the printed image with smoothing techniques that decrease resolution but, importantly, reduce noise. One such technique dilutes the ink (by one-fourth the original optical density by adding three parts solvent) such that the ink drop which would have been deposited on a single pixel (in, for example, a 600 dpi resolution) is spread over at least portions of adjacent pixel areas. While each drop would contain the same amount of colorant, the additional solvent causes the colorant to be distributed over a wider area. As stated, this lowers the visual noise at the cost of perceived resolution. Additionally, this technique places substantially more solvent on the printed medium resulting in an unacceptably long time to dry, consumes much more fluid consumables for printing, and slows down the speed of printing.

Large drops create large dots, or larger groups of dots that are quite visible in transition zones. Moreover, each of these methods consume ink at a rapid rate and are thus more expensive to operate. Drop volume control and multi-drop methods of inking are taught respectively by U.S. Pat. No. 4,967,208 to Winthrop D. Childers for an "Offset Nozzle Droplet Formation" and U.S. Pat. No. 5,485,180 to Ronald A. Askeland et al. for "Inking for Color-Inkjet Printers, Using Non-Integral Drop Averages, Media Varying Inking, or More Than Two Drops Per Pixel" (each assigned to the assignee of the present invention). In a multi-drop mode, the resulting dot will vary in size or in color depending on the number of drops fired at an individual pixel or superpixel and the constitution of the ink with respect to its spreading characteristics after impact on the particular medium being printed (plain paper, glossy paper, transparency, etc.). The reflectance and color of the printed image on the medium is modulated by manipulating the size and densities of drops of each color at each target pixel. The quantization effects of this mode can be reduced in the same ways as for the single-drop per pixel mode. The quantization levels can also be reduced at the same printing resolution by increasing the number of drops that can be fired at one time from nozzles in a printhead array and either adjusting the density of the ink or the size of each drop fired so as to achieve full dot density. However, simultaneously decreasing drop size and increasing the printing resolution, or increasing the number of pens and varieties of inks employed in a hard copy apparatus is very expensive, so older implementations of inkjet hard copy apparatus designed specifically for imaging art reproduction generally use multi-drop modes or multiple passes to improve color saturation.

When the size of the printed dots is modulated, the image quality is very dependent on dot placement accuracy and resolution. Misplaced dots leave unmarked pixels which appear as white dots or even bands of white lines within or between print swaths (known as "banding"). Mechanical tolerances become increasingly critical in the construction as the printhead geometries of the nozzles are reduced in order to achieve a resolution of 600 dpi or greater. Therefore, the cost of manufacture increases with the increase of the resolution design specification. Furthermore, as the number of drops fired at one time by multiplexing nozzles increases, the minimum nozzle drop volume decreases, dot placement precision requirements increase. Also the thermal efficiency of the printhead becomes low, leading to high printhead temperatures. High printhead temperatures can lead to reliability problems, including ink out-gassing, erratic drop velocities due to inconsistent bubble nucleation, and variable drop weight due to ink viscosity changes.

When the density of the printed dots is modulated as in multi-dye load ink systems, the low dye load inks require that more ink be placed on the print media, resulting in less efficient ink usage and higher risk of ink coalescence and smearing. Ink usage efficiency decreases and risk of coalescence and smearing increases with the number of drops fired at one time from the nozzles of the printhead array.

Another methodology for controlling print quality is to focus on the properties of the ink itself. When an ink drop contacts the print media, lateral diffusion ("spreading") begins, eventually ceasing as the colorant vehicle (water or some other solvent) of the ink is sufficiently spread and evaporates. For example, in U.S. Pat. No. 4,914,451 to Peter C. Morris et al., "Post-Printing Image Development of Ink-Jet Generated Transparencies", assigned to the assignee of the present invention, lateral spreading of each drop is controlled with media coatings that control latent lateral diffusion of the printed ink dots. However, this increases the cost of the print media. Lateral spreading also causes adjacent drops to bleed into each other. The ink composition itself can be constituted to reduce bleed, such as taught in U.S. Pat. No. 5,196,056 for an "Ink Jet Composition with Reduced Bleed" to Keshava A. Prasad and assigned to the assignee of the present invention. However, this may result in a formulation not suitable for the spectrum of available print media that end users may find desirous.

One apparatus for improving print quality is discussed in a very short article, *Bubble Ink-Jet Technology with Improved Performance*, by Enrico Manini, Olivetti, presented at IS&T's Tenth International Congress on Advances in Non-Impact Printing Technologies, Oct. 30–Nov. 4, 1994, New Orleans, La. Manini shows a concept for, "better distributing the ink on the paper, by using more, smaller droplets . . . utiliz(ing) several nozzles for each pressure chamber, so that a fine shower of ink is deposited on the paper." Sketches are provided by Manini showing two-nozzle pressure chambers, three-nozzle chambers, and four-nozzle chambers. Manini shows the deposition of multiple droplets of ink within a pixel areal dimension such that individual drops are in adjacent contact or overlapping. Manini alleges the devices abilities: to make a square elementary dot to thereby provide a 15% ink savings and faster drying time; to create better linearity in gray scaling; and to allow the use of smaller nozzles which allow higher capillary refill (meaning a faster throughput capability—generally measured in printed pages per minute, "ppm"). No working embodiment is disclosed and Manini himself admits, "The hydraulic tuning between the entrance duct and the outlet nozzles is however rather complex and requires a lot of experimentation."

Manini, however, only followed along the path of prior U.S. Pat. No. 4,621,273, filed on Dec. 16, 1982, teaching a "Print Head for Printing or Vector Plotting with a Multiplicity of Line Widths" to Dean A. Anderson and assigned to the assignee of the present invention. Anderson shows a multi-nozzle arrangement (a "primitive") for an 80–100 dpi raster/vector plotter with ink jet nozzles at selected points of a two-dimensional grid. However, while Anderson teaches a variety of useful primitive patterns (see e.g., FIGS. 1A–2B therein), the dot pattern is specifically limited by having only one nozzle in any given row or column. Selective firing is then directed depending on the plot to be created. A heavy interlacing of dots is required as demonstrated in FIGS. 4 and 5 therein.

Another problem with thermal inkjet printheads is the phenomenon known as "puddling." An ink drop exiting an orifice will tend to leave behind minute amounts of ink on the nozzle plate surface about each orifice. As these puddles grow, surface tension between the puddle and an exiting ink drop will tend to attract the tail of the drop and change its trajectory. A change in trajectory means the drop will not hit its targeted pixel center, introducing printing errors on the media. Tuning of nozzle plates is proposed in U.S. Pat. No. 4,550,326 to Ross R. Allen et al. for "Fluidic Tuning of Impulse Jet Devices Using Passive Orifices" (assigned to the assignee of the present invention).

Another problem in inkjet printing occurs at higher resolutions, for example, in multi-pass and bidirectional 300 dpi printing. Misaligned drops from different drop offsets created when the printing is accomplished by first scanning the printhead left-to-right then scanning right-to-left, cause adverse consequences such as graininess, hue shift, white spaces, and the like. This forces most printers yielding photographic color quality to always print in one direction or to interlace the scans. In either event (or when using both) the printer is forced to print at a lower printing speed. See, for example, U.S. Pat. No. 5,369,428, "Bi-directional Ink Jet Printing" to Robert C. Maze et al. Normally, binary drops are deposited in a "blackout" pattern on the grid of square pixels such that drops overlap to a degree necessary to ensure no visible white spaces occur at the four comers of the target pixel (as taught by Trask, Doan, and Hickman, supra). As mentioned, ink usage is dramatically increased by these techniques. Moreover, print media line feed error is significant compared to drop size and, without multiple-drop or overlap between pixels, white banding between swaths occurs. Thus, each of these prior art inventions are using more ink than would be required if perfectly accurate trajectories of perfectly sized ink drops could be achieved.

Therefore, until a technological breakthrough to achieve such perfection is attained, there remains a need for improvement in thermal inkjet printheads and methods of distribution of ink drops to achieve superior print quality, decreasing quantization effects, and ink usage. The goal is to reduce the required reflectance and color quantization levels of an inkjet printing system for high printing fidelity without requiring higher dot placement printing resolution while also increasing data throughput.

SUMMARY OF THE INVENTION

An inkjet printhead has an array of drop generators employed to eject ink to form dots on a print medium. A plurality of ink ejecting nozzles is associated with one drop generator of the array of drop generators such that each nozzle of the plurality of ink ejecting nozzles ejects an ink droplet essentially simultaneously when the one drop generator is activated. The plurality of ink ejecting nozzles is arranged to eject a droplet during the first activation of the one drop generator and place a majority of dots on the print medium outside a target pixel disposed opposite said one drop generator.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

FIGS. 10A, 10B, 10C and 10D are color comparison sample prints demonstrating print quality improvement in accordance with the use of a multi-nozzle printhead constructed in accordance with the present invention.

Figure 1:
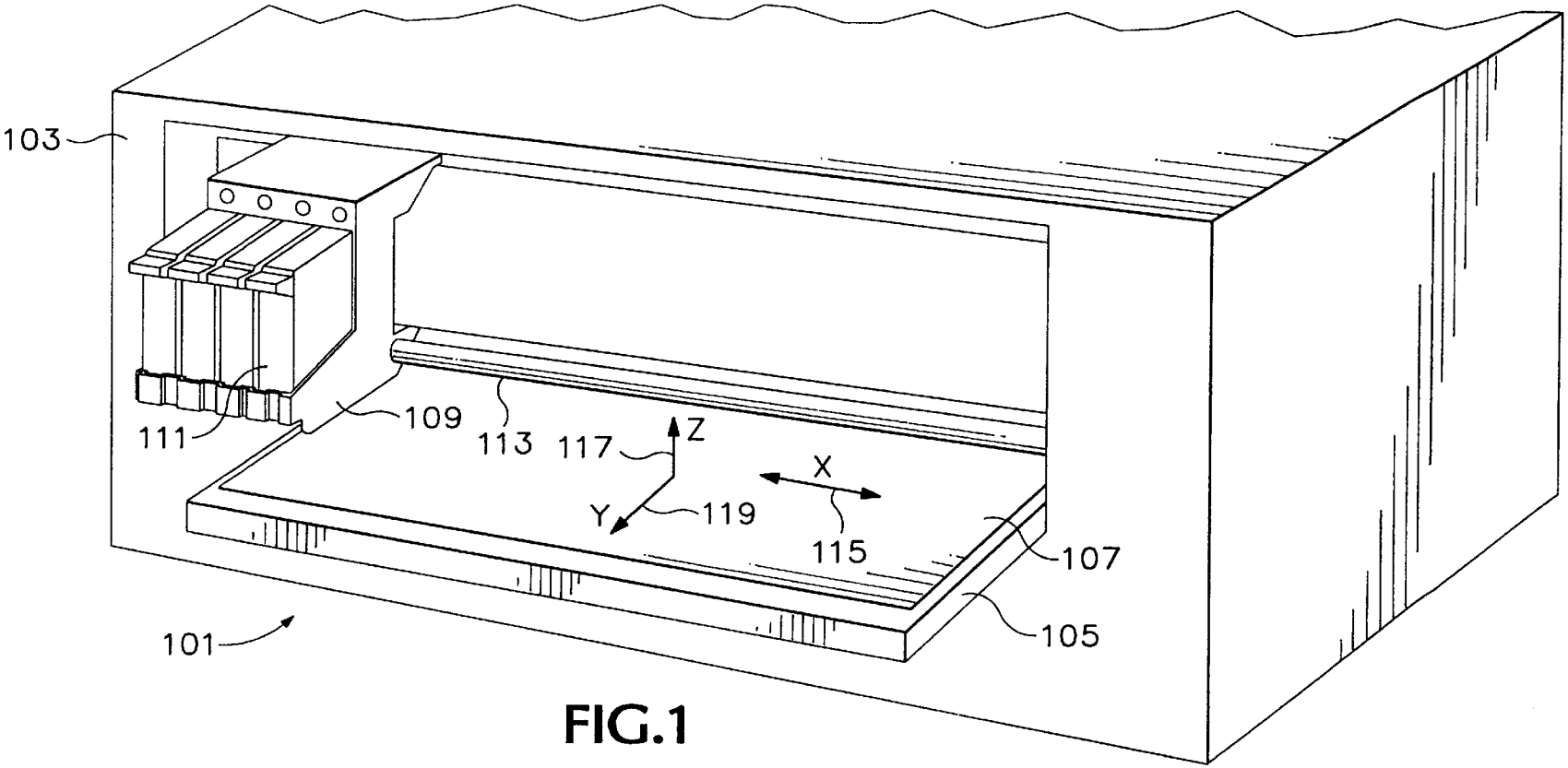
FIG. 1 is a schematic drawing in perspective view (partial cut-away) of an inkjet apparatus (cover panel facia removed) in which the present invention is incorporated.

The drawings referred to in this specification should be understood as not being drawn to scale except if specifically noted.

DESCRIPTION OF THE PREFERRED EMBODIMENTS

It is useful to define some of the terms used in describing the preferred embodiments of the present invention. As used herein, a drop is contemplated to be a single unit of ink, normally directed toward and deposited upon a single resolution element, a pixel, of a recording medium, resulting in a binary pattern at the pixel resolution. A pixel, in inkjet printing, is equivalent to the fundamental drop spacing in a conventional printer, and, in a typical inkjet printer, is therefore equivalent to a single increment of motion of the printing mechanism (i.e. printhead) carriage (in the direction of printhead translation) and the printhead nozzle spacing in the direction of movement of the media through the printer. A nozzle is the orifice in the printhead that ejects a volume of ink upon activation of an ink ejector. A droplet is one of the several to many units of ink, the totality of which are simultaneously expelled from a single drop generator and directed toward and deposited upon a medium. It is a feature of the present invention that the simultaneously expelled droplets may be deposited upon the medium both within and outside of the boundaries of the defined pixel. Since it is the absorption of particular wavelengths of light by the colorant component of the ink deposited upon the medium that provides the light spectrum distribution perceived by humans as color, description of the light wavelength interaction characteristic of ink dots deposited upon a medium will be termed herein light absorption. The sum of the light absorption of the dots deposited by simultaneously fired droplets generally would be the same as that of the conventionally deposited dot, but the light absorption region on the medium would be spread out over an area greater than the target pixel area. A conventionally deposited dot in a conventional pixel will have a greater light absorption in that pixel than dots from the simultaneously expelled droplets in that pixel. An ink ejector, in the preferred embodiment, comprises multiple nozzles associated with a propulsive element such as a heater resistor (which may be segmented into cooperating parts) to vaporize ink and direct a volume of ink, as droplets essentially simultaneously ejected from the multiple nozzles, toward the medium.

The fundamental nature of the present invention is that by taking the ink that would have been put on, for example, a 600 dpi pixel and spreading it out over a larger area, one can reduce granularity and minimize the effect of certain other printing artifacts such as line feed accuracy. The present invention does this by (in one or more mechanisms) distributing the ink that would otherwise have been deposited on a single pixel in a single ink expulsion event into multiple pixels. While one way of spreading the ink is to put additional solvent in the drop and depositing dilute drops as mentioned above, such a technique would result in too much solvent on the medium, thereby producing cockle of the medium and a long dry time. Nevertheless, it would produce similar visual effects by lowering apparent graininess and reducing the visual impact of line feed errors. A plurality of drops rapidly and sequentially ejected from a conventional single ink emitter generally would, in the simplest implementation, cover the same total area on the medium as a single pixel, but the ink would be spread out outside the normal pixel by some amount. It is a feature of the present invention that a majority, if not all, of the simultaneously ejected ink droplets from a single ink ejector are deliberately deposited outside of a predetermined pixel area on the medium. While droplets going outside the single pixel will lower the intrinsic resolution, the resolution of the human eye is exceeded for color printing at 600 dpi, and gains in resolution beyond this in color is not perceived by unaided humans. Therefore, use of the present invention results in a trade of resolution for lower noise and artifact hiding.

If, instead of using infinitely many simultaneous droplets per ink ejector, one uses a finite number such as four, one should expect to encounter a residual visual "noise" in the form of granularity and other artifacts-although that noise is still less than that which would come from a single drop per ink ejector. A further feature of the present invention is the introduction of "rotated quads" and "counter rotated quads" which can be related to the rotated screens found in magazine printing. These rotated quads essentially "micro screen" patterns to remove Moiré patterns and greatly reduce clustering noise without increasing the amount of data needed, as would be the case in a true 1200 dpi image. Thus, use of the present invention approximates the effects of a dilute fluid spreading a color into a large area by depositing many little dots in specific patterns over larger than a single pixel area. In doing so a number of additional benefits such as lower printhead operating temperature, higher speed, defective nozzle redundancy, and reduced ink usage for a desired color saturation are gained. Furthermore, once one has achieved these characteristics, one obtains a number of derivative benefits such as the ability to do bi-directional printing at speed which is today, limited by hue shift coming from misaligning color planes traveling left to right versus right to left. Because the methodology of the present invention is intrinsically less sensitive to misalignment, for a given mechanical tolerance, it is possible to achieve bidirectional printing without significant hue shift.

Accordingly, an exemplary inkjet hard copy apparatus, a computer printer 101, is shown in rudimentary form in FIG. 1. A printer housing 103 contains a platen 105 to which input print media 107 is transported by mechanisms as would be known in the state of the art. A carriage 109 holds a set 111 of individual print cartridges, one having cyan ink, one having magenta ink, one having yellow ink, and one having black ink. (Alternatively, inkjet "pens" comprise semi-permanent printhead mechanisms having at least one small volume, on-board, ink chamber that is sporadically replenished from fluidically-coupled, off-axis, ink reservoirs; the present invention is applicable to both inkjet cartridges and pens.) The carriage 109 is mounted on a slider 113, allowing the carriage 109 to be scanned back and forth across the print media 107. The scan axis, "X," is indicated by arrow 115. As the carriage 109 scans, ink drops can be fired from the set 111 of print cartridges onto the media 107 in predetermined print swath patterns, forming images or alphanumeric characters using dot matrix manipulation. Generally, the dot matrix manipulation is determined by a computer (not shown) and instructions are transmitted to an on-board, microprocessor-based, electronic controller (not shown) within the printer 101. The ink drop trajectory axis, "Z," is indicated by arrow 117. When a swath of print has been completed, the media 107 is moved an appropriate distance along the print media axis, "Y," indicated by arrow 119 and the next swath can be printed.

Figure 2:
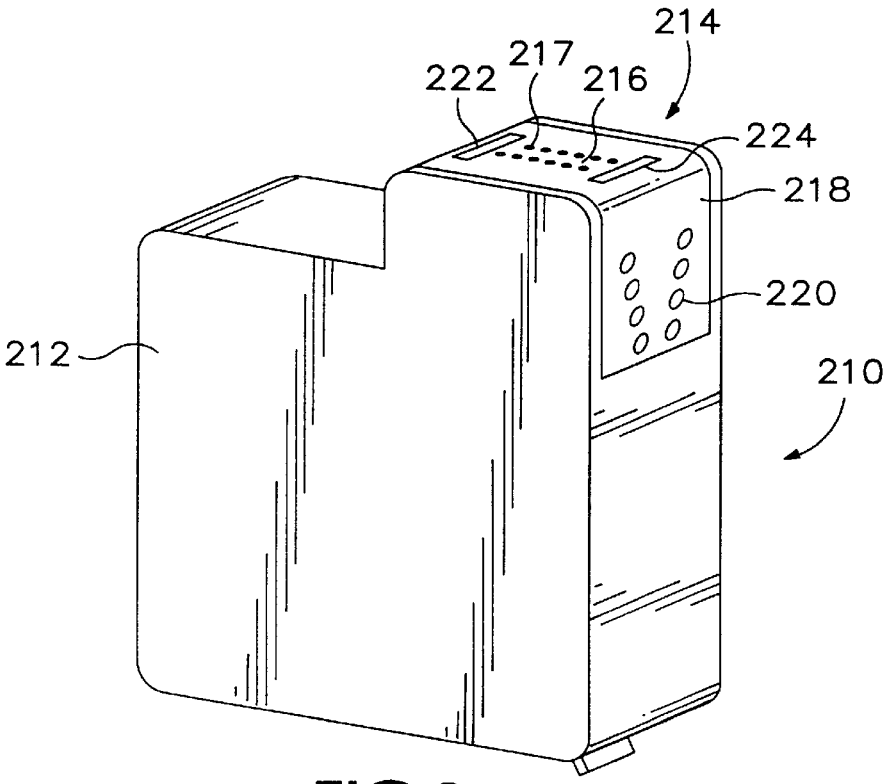
FIG. 2 is an isometric schematic drawing of an inkjet print cartridge component of FIG. 1.
Figure 2A:
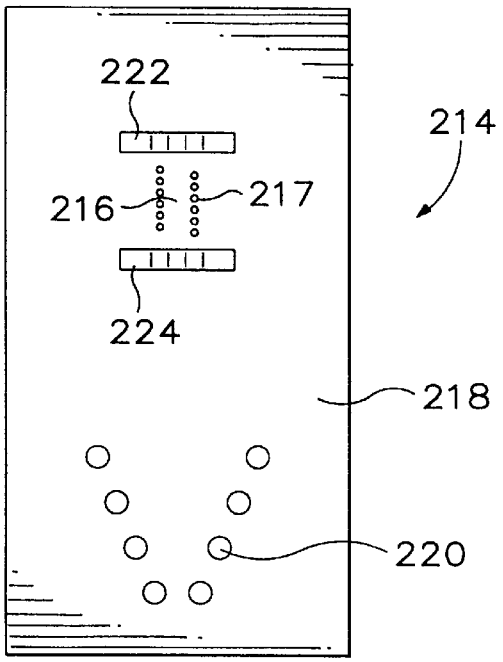
FIG. 2A is a schematic drawing of detail of a printhead component of the print cartridge of FIG. 2.

An exemplary thermal inkjet cartridge 210 is shown in FIGS. 2 and 2A. A cartridge housing, or shell, 212 contains an internal reservoir of ink (not shown). The cartridge 210 is provided with a printhead 214, which may be manufactured in the manner of a flex circuit 218, having electrical contacts 220. The printhead 214 includes an orifice plate 216, having a plurality of miniature nozzles 217 constructed in combination with subjacent structures leading to respective ink ejectors, which in thermal inkjet implementations are realized as heating elements (generally electrical resistors), that are connected to the contacts 220; together these elements form a printhead array of "drop generators" one of which is shown in the cross sectional detail of FIG. 2B and described in exemplary U.S. Pat. Nos. 4,967,208 and 5,278,584, "Ink Delivery System for an Inkjet Printhead", to Brian J. Keefe et al.; see also, U.S. Pat. No. 5,291,226, "Nozzle Member Including Ink Flow Channels" to Christopher A. Schantz et al.; U.S. Pat. No. 5,305,015, "Laser Ablated Nozzle Member for Inkjet Printhead" to Christopher A. Schantz et al.; and U.S. Pat. No. 5,305,018, "Excimer Laser-Ablated Components for Inkjet Printhead" to Christopher A. Schantz et al., each assigned to the assignee of the present invention and teaching methodologies for the manufacture of laser ablated printhead components). FIG. 2A depicts a simplified commercial design having an array of nozzles 217 comprising a layout of a plurality of single nozzle drop generators arranged in two parallel columns. Thermal excitation of ink via the heating elements is used to eject ink drops through the nozzles onto an adjacent print medium (see FIG. 1, element 107). In one exemplary commercial product such as the Hewlett-Packard DeskJet™ printer, model 722, one hundred and ninety-two (192), single nozzle, drop generators are employed to allow 300 dpi print resolution, however greater print resolution is available in other commercially available products.

Figure 2B:
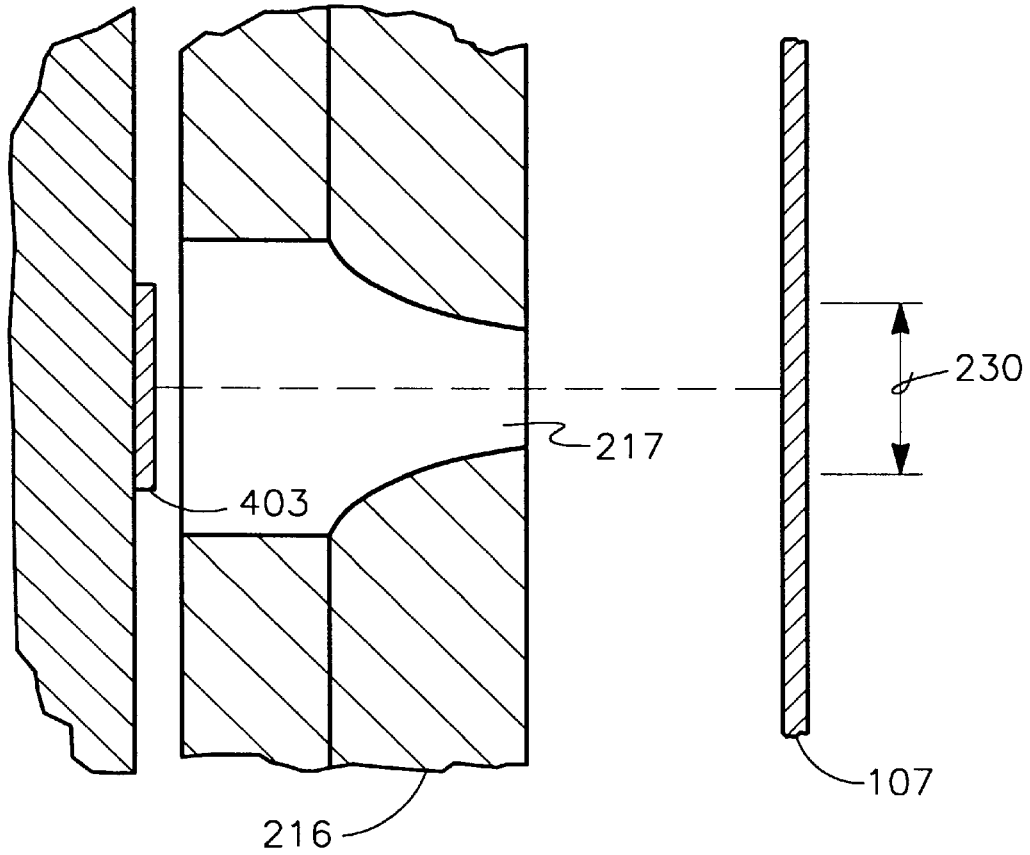
FIG. 2B is a cross section of a drop generator element of the printhead component of FIG. 2A.

A conventional drop generator which can be utilized in the printhead 214 is shown in the cross section through one of the drop generators in FIG. 2B. The orifice plate 216 is penetrated by a nozzle 217 extending from an ink entrance port opposite a heating element 403 to an ink exit orifice. Ink is expelled from the exit orifice and is deposited as an ink drop in a target pixel 230 on the print medium 107.

Nozzle configurations, one aspect of the present invention, are design factors that control droplet size, velocity and trajectory of the droplets of ink in the Z-axis. The standard drop generator configuration has one orifice and is fired in either a single-drop per pixel or multi-drop per pixel print mode. (In the single-drop mode (known as "binary"), one ink drop is selectively fired from each nozzle 217 from each print cartridge 210 toward a respective target pixel on the print media 107 (that is, a target pixel might get one drop of yellow from a nozzle and two drops of cyan from another nozzle in successive scans of the carriage to achieve a specific hue); in the multi-drop mode to improve saturation and resolution two sequential droplets of yellow and four of cyan might be used for that particular hue which might be done on one pass of the carriage. (For the purpose of this description and the claims of the present invention, a target pixel shall mean a pixel which a drop generator is traversing as an inkjet printhead is scanned across an adjacent print medium, taking into consideration the physics of firing, flight time, trajectory, nozzle configuration, and the like as would be known to a person skilled in the art; that is, in a conventional printhead it is the pixel at which a particular drop generator is aiming; as will be recognized based on the following detailed description, with respect to the present invention, the target pixel may differ in location from a pixel on which the drop generator of the present invention forms dots; that is, dots may be formed in pixels other than the currently traversed pixel, i.e., other than the traditional target pixel.)) The resulting dot on the print media is approximately the same size and color as the dots from the same and other nozzles on the same print cartridge.

It is a feature of the present invention that a drop generator comprises a plurality of nozzles for ejecting ink. Comparing FIGS. 3A–C and 4A–B to FIGS. 2, 2A and 2B, it will be recognized that in a multi-nozzle drop generator design, the orifice plate can have a variety of layout configurations for each drop generator. In one commercial embodiment, a printhead with 192 nozzles could be replaced with a printhead having 192 sets of four nozzles (768 nozzles in all). Note that since the number of heating elements has not been changed from the construct depicted in FIGS. 1–2B to achieve the configurations in FIGS. 3A–3C and FIG. 4B, a retrofit using the same controller is possible.

Figure 3A:
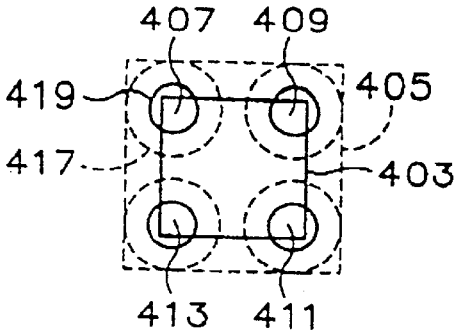
FIGS. 3A, 3B and 3C are schematic drawings (top view) of three different nozzle placement configurations relative to a central heating element of an inkjet printhead drop generator constructed in accordance with the present invention.
Figure 3B:
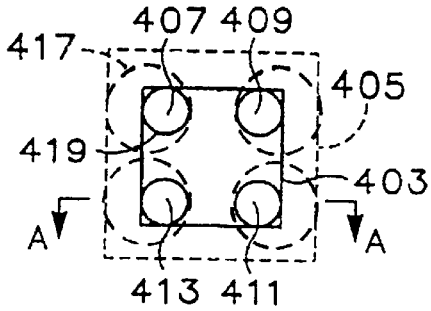
Figure 3C:
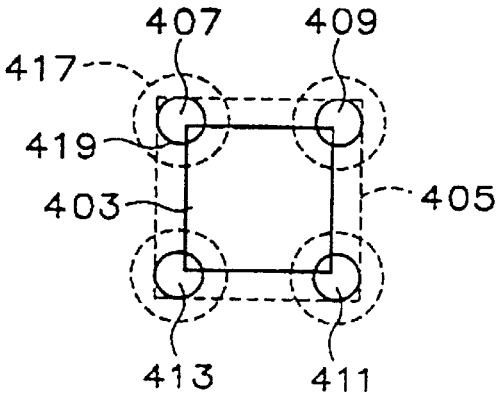
Figure 4A:
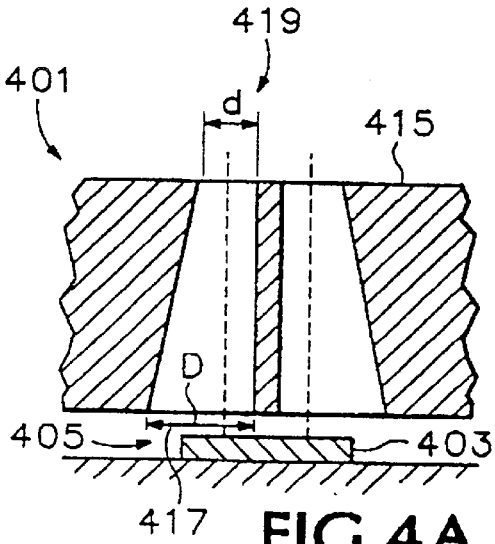
FIG. 4A is a schematic drawing of a cross-section of an ink drop generator, taken in cross-section A—A of FIG. 3B.
Figure 4B:
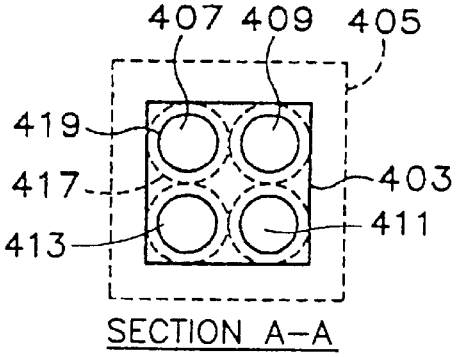
FIG. 4B is a schematic drawing (top view) of a fourth nozzle placement configuration relative to a central heating element of a drop generator as shown in FIGS. 3A–3C.

In cross-section as generally depicted in FIG. 4A, taken in section A—A of FIG. 3B, a drop generator 401 is formed using, for example, known laser ablation construction (see Background section and Schantz et al. U.S. patents, supra), having a heating element, resistor 403, located in an ink firing chamber 405. In a top-firing (versus side-firing) embodiment, nozzles 407, 409, 411, 413 are cut through a manifold 415. Each nozzle 407, 409, 411, 413 is tapered from an ink entrance diameter, "D," 417, superjacent the heating element 403 to a distal, narrower, ink drop exit diameter, "d," 419. (In order to clearly distinguish the nozzle elements, the entrance proximate the heating element 403 is referred to as an ink "entrance port" and the distal ink exit from the nozzle from which ink droplets are expelled toward the print media is referred to as an "exit orifice".) A comparison of FIGS. 3A, 3B, 3C and 4B exemplifies that a variety of design relative configurations are possible (the examples are not intended to limit the scope of the invention to only the shown layouts as others, including both even and odd number of nozzle/orifice set arrays and combinatorial nozzle/orifice sets will be apparent to those skilled in the art). It should be kept in mind that a specific optimal layout may be dependent upon many apparatus design factors, including scan velocity, ink composition, ink droplet flight time, flight distance between the orifice plate and the media, and the like as would be known to a person skilled in the art. Moreover, in the preferred embodiment of the present invention, it is specifically intended that the droplets simultaneously fired do not merge in flight. In an alternative embodiment, the nozzles of an ink ejector are arranged such that the droplets expelled therefrom diverge in flight from the nozzle to the medium. This embodiment allows the pitch of the heater resistor to be arranged such that the heater resistors are disposed closer together, no longer limited by the position of the nozzles. This allows heater resistors, using present resistor and substrate design rules, to be positioned on 600 dpi pitches.

Moreover, note that the mix of nozzles per drop generator need not be a constant throughout the array for a given color. That is, a first ink ejector may have three nozzles and another ink ejector in the same array may have six nozzles. Similarly, the location and symmetry of nozzles in ink ejectors with the same number of nozzles may vary. Furthermore, the ink volume ejected by each nozzle may be designed to be different to achieve desirable image quality.

In one embodiment, each exit orifice has an exit orifice areal dimension sized to eject a droplet that will create a dot on the target medium that is less than or equal to the integer 1 divided by the number of orifices per drop generator times the areal dimension of a pixel $(1/n)\cdot P_a$, where "n" is the number of orifices per drop generator and "$P_a$" is the area of a pixel to be printed. For example, if three nozzles are in a particular drop generator, each exit orifice is sized to produce a dot whose area is equal to or less than ⅓ times the area of a pixel, e.g., $(1/3)\cdot(1/300)^2$ sq. in.; if four nozzles are used per drop generator, each exit orifice is sized to produce a dot whose area is equal to or less than $(1/4)\cdot(1/300)^2$ sq. in., etc. This relationship can vary, however, depending upon other design parameters of the orifices. It is a feature of the present invention that, regardless of the orifice exit area, the simultaneously generated ink droplets be distributed as dots onto an adjacent print medium as sets of dots having an area less than or equal to the product of the dividend of one divided by the number of nozzles and the area of the target pixel. That is, $$\text{area}_{dot} \leqq (1/n)\cdot P_a,$$

where n is the number of nozzles per drop generator producing a dot and $P_a$ is the area of a target pixel to be printed. In a preferred embodiment, a dot diameter of less than or equal to approximately twenty to twenty-five microns is desirable. Generally, at least one dot will lie outside the target pixel and, in a favored embodiment, all dots will be outside the target pixel. When droplets are spaced by twenty to twenty-five microns, they have become invisible to the naked eye. See, for example, FIGS. 9A–9C.

Each drop generator is designed so that the light absorption of the ink ejected per firing is, in total, approximately that which would have occurred in a corresponding ink drop ejection from a conventional drop generator onto the target pixel—but it is spread out in fine dots over a larger area than the single pixel of the conventional single drop technique. The distribution of these simultaneously fired droplets over an area larger than the conventional area offers advantageous printing characteristics. In the simplest implementation, a printhead has sets of drop generators and all or some of the drop generators having a plurality, for example four, simultaneously firing nozzles. The nozzles are sized and arranged to produce resultant dots covering approximately the same total area of the printed medium as the conventional single pixel. That is, for one firing of a drop generator, the four simultaneously ejecting nozzles direct the droplets toward the medium in a fashion that produces a spaced apart deposition of dots. A predetermined amount of uninked medium appears between the dots. Since the dots are placed on the medium over an area greater than the single pixel, the apparent light absorption per unit area of the simultaneously fired dots will be perceived as less than the light absorption per unit area of a single dot formed in the target pixel from a conventionally ejected drop.

Stated another way, each simultaneously ejected ink droplet is expelled with a predetermined drop weight (W) which is established within reasonable limits of tolerance by the well known interactions of inkjet ejection mechanics. For most, if not all, of the drop generators in the particular array (or color group) the number of nozzles is established as a fixed number, n, which in a preferred embodiment is four. The total ink drop weight ejected by one drop generator for one ejection event is therefore (n·W). If a single drop having an equivalent drop weight, (n·W), were conventionally deposited as a single dot in a target pixel, the light absorption of that single dot in the target pixel would be a certain value. Since the n simultaneously ejected droplets have the same total drop weight as the conventionally fired single drop, the sum of the total light absorption of the dots resulting from the n simultaneously ejected droplets will be approximately equal to that of the dot resulting from the single, conventional, dot. But, the simultaneously ejected droplets result in dots dispersed over an area greater than a single pixel. Thus, when compared on a pixel area basis, the sum of the light absorption of all of the dots resulting from the simultaneously ejected droplets within any given pixel can be less than that of the conventionally deposited dot in the target pixel. Thus, for one ink expulsion event for one ink ejector:

$$n \cdot A_d \simeq A_c|_{total\ \ deposition}$$

and $$n \cdot A_d \simeq A_c|_{any\ pixel\ deposition}$$

where $A_d$ is the light absorption of one dot resulting from a plurality of n droplets simultaneously expelled from n ink ejecting nozzles, where W is the drop weight of each of the n droplets, and where $A_c$ is the light absorption of the conventionally deposited drop having a drop weight of (n·W).

The drop weights for each of the simultaneously expelled droplets from the same drop generator are not required to have identical drop weights. In an alternative embodiment, the sum of the drop weights equal the drop weight ($W_c$) of a single conventionally deposited drop:

$$W_1 + W_2 + \ldots W_n = W_c$$

For one ink expulsion event for one ink ejector having n ejecting nozzles:

$$\sum_1^n A_{dN} \simeq A_c|_{total\ deposition}$$

-continued and $$\sum_1^n A_{dN} < A_c|_{any\ pixel\ deposition}$$

In some instances the sum of the absorptions of the dots formed by a plurality of n simultaneously expelled droplets is greater than that of the single dot formed by a conventionally expelled drop having a weight equal to the sum of n droplets. Media to be printed upon, particularly paper, has a wide range of characteristics that affect inkjet printing. See, for example, Donald J. Palmer et al., "Ink and Media Development for the HP Paintjet Printer", Hewlett-Packard Journal, August 1988, pp. 45–50; David L. Lee et al., "Engineering an Ink Jet Paper What's Involved?", Recent Progress in Ink-Jet Technologies, Society for Imaging Science and Technology, 1996, pp. 247–253; and J. Borch, "Plain Paper Choices for Ink Jet Printing", Recent Progress in Ink-Jet Technologies, Society for Imaging Science and Technology, 1996, pp. 288–292. For those papers in which the ink penetrates into the paper (that is, the volume of ink does not totally spread across the surface of the paper), more ink volume of a conventionally expelled single drop of weight (n·W) is wicked into the paper than for a plurality of n droplets of weight W deposited at spaced apart positions on the paper. Should such greater wicking for large drops occur, the sum of the areas of paper covered by the smaller droplets will be slightly larger than that of the single large drop. Since more of the ink (and colorant) has wicked deeper into the paper, where its light absorption is less effective, a greater light absorption is realized by the sum of n individual dots produced by the plurality of simultaneously expelled droplets than is realized by the dot resulting from the single conventionally expelled drop. A significant resulting advantage from the multiple simultaneously expelled droplets over the conventional single drop technology is that the amount of ink for a given desired light absorption can be reduced, thereby providing improved dry time and reduced paper cockling. Thus, under certain fluid-wicking media conditions:

$$n \cdot Ad \geqq Ac|_{total\ deposition\ (wicking)}$$

Figure 5:
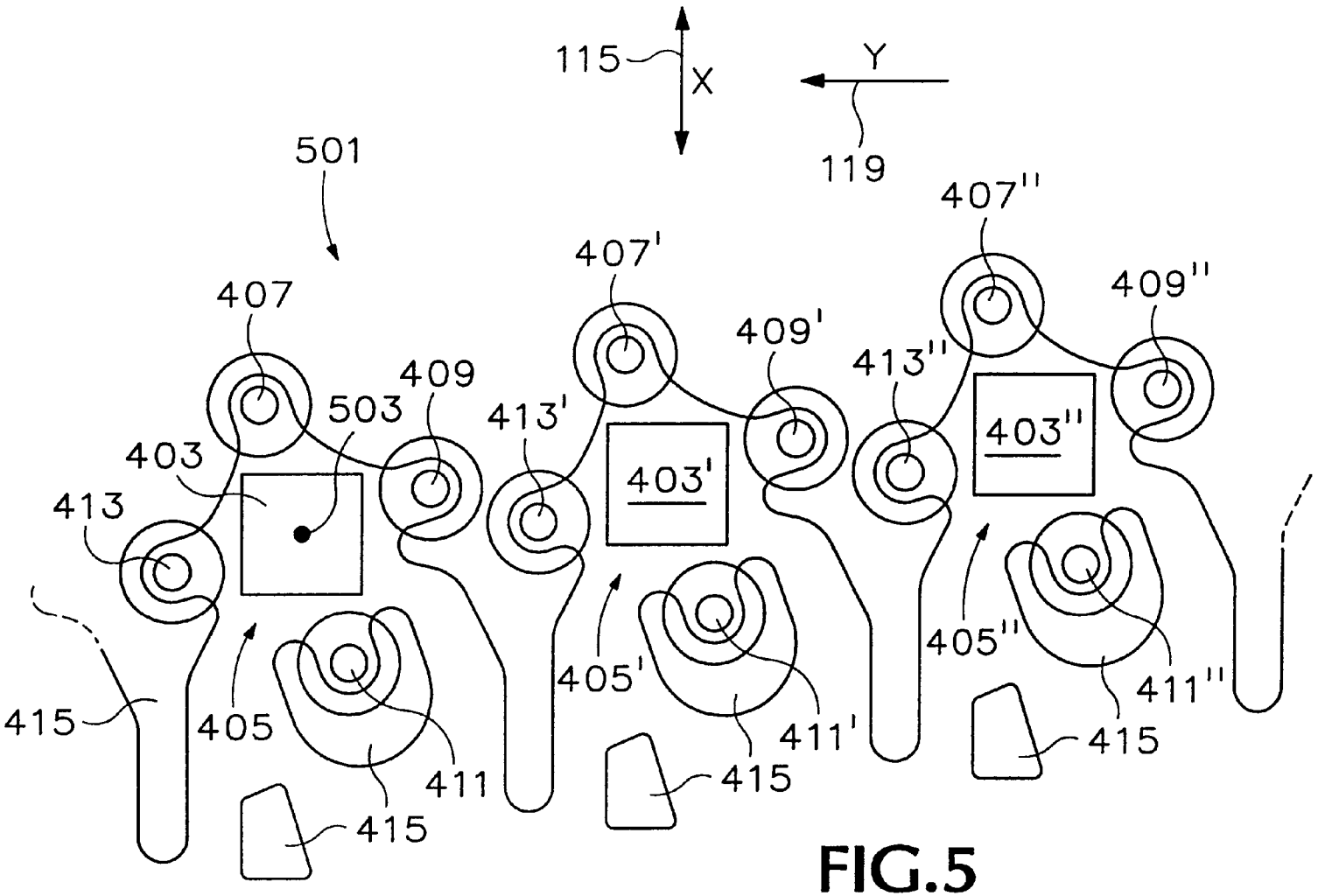
FIG. 5 is a schematic drawing (top view) of a set of three, four nozzle, one heating element, inkjet drop generators (a portion of a fall array) in accordance with one embodiment of the present invention.
Figure 9A:
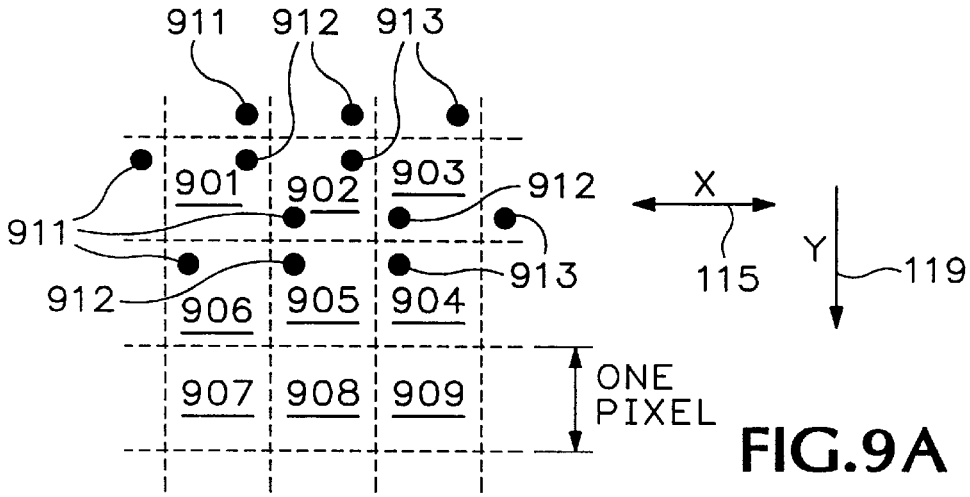
FIGS. 9A, 9B, and 9C demonstrate a method of sequential scanning passes for printing a dot matrix formed in accordance with the present invention using a single multi-nozzle drop generator.
Figure 9B:
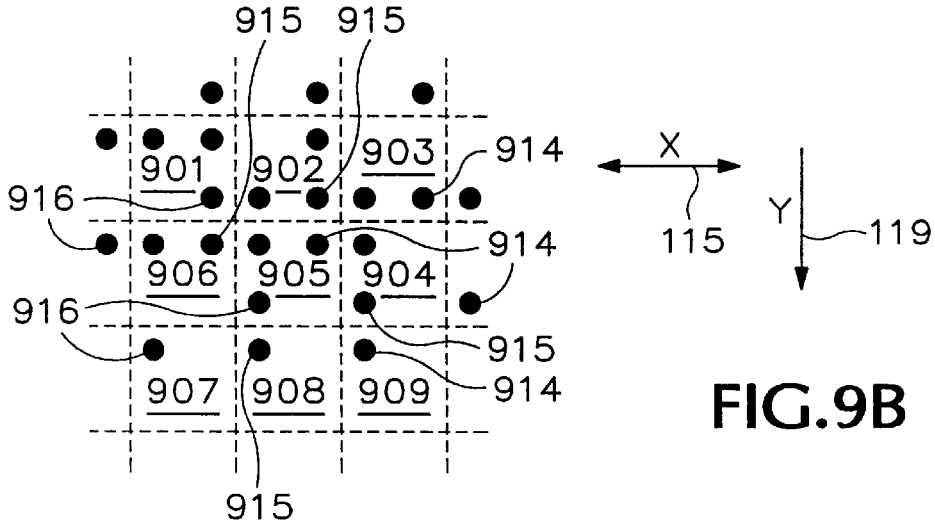
Figure 9C:
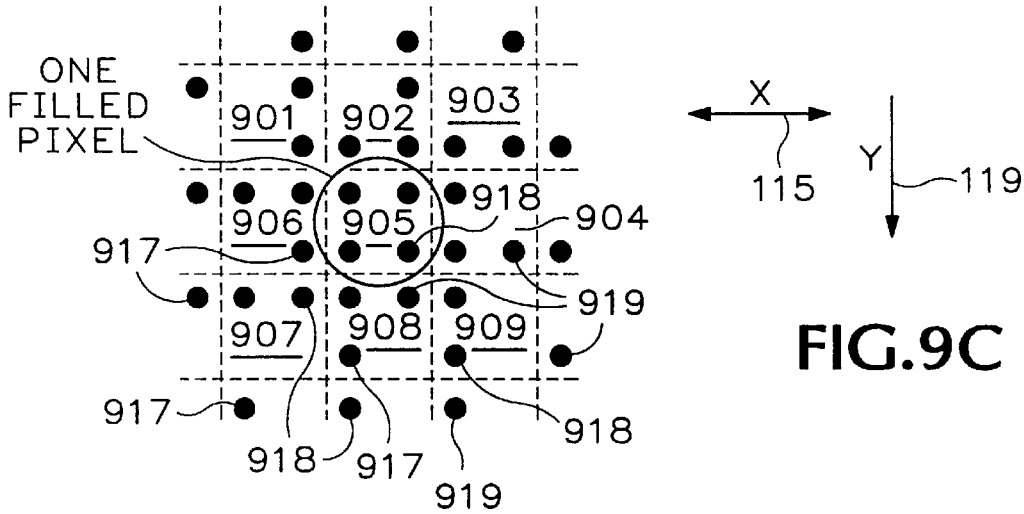

Printing operation in accordance with the present invention is depicted in FIGS. 9A–9C, showing a contiguous set of nine arbitrary pixels, 901–909, from a full grid overlay of an image to be printed. (This depiction is greatly magnified; in commercial designs each pixel generally will be 1/300 inch by 1/300 inch or smaller). For convenience of explanation, the firing of a single ink ejector of four nozzles as shown in FIG. 5 is described in order to achieve a dot fill of more than one pixel 905. Assume a central pixel 905 of this grid subsection is to be essentially covered with ink. As shown in FIG. 9A, in the first scan pass, four ink droplets deposit dots 911 about pixel 901 in accordance with instructions from the printer controller from one set of nozzles (e.g. nozzles 407", 409", 411", 413"as shown in FIG. 5). The depiction of the dot sizes in FIGS. 9A–9C not withstanding, the area of the medium covered by any particular simultaneously ejected dot is defined by the foregoing $area_{dot} \leqq (1/n) \cdot P_a$. A rotated nozzle architecture, described below, simultaneously deposits a dot in each of pixels 902 and 906, as shown in FIG. 9A, and in two pixels outside the exemplary grid area 901–909. Upon translation of the printhead in the X direction, four dots 912 are deposited, including a first ink dot in the upper left quadrant of the exemplary pixel 905 and dots in pixels 901 and 903. Upon the translation of the printhead another X direction increment so that the nozzle set is over pixel 903, four dots 913 are deposited, including dots in pixels 902 and 904. (In this example, only a single pixel row is being printed per pass; it will be recognized by a person skilled in the art that the complexity of the firing algorithm during this first pass is dependent upon the image being produced and the full construction of the printhead implementation with many pixels in a nozzle array wide swath are being inked simultaneously, including drop-on-drop mixing of primary color inks to produce all of the hues and luminance ratios of the image that are required to reproduce the image faithfully.) At the end of the first pass, the media is shifted in the Y direction, perpendicular to the translation direction of the print head, enabling the printing of a second swath during the next scan pass across the print medium.

FIG. 9B depicts a second pass, for example in the -X direction from right to left, that first deposits four ink dots 914 about pixel 904, including an ink dot in the upper right quadrant of the target pixel and dots in pixels 903 and 909. Upon translation of the printhead so that the nozzle set is over the exemplary pixel 905, four dots 915 are deposited, including dots in the pixels 902, 904, 906 and 908. Upon the translation of the printhead another increment, so that the nozzle set is over pixel 906, four dots 916 are deposited, including a third ink dot in the lower left quadrant of the exemplary pixel 905, and dots in pixels 901 and 907.

Similarly, FIG. 9C depicts a third pass, for example from left to right. Four ink dots 917 are deposited about pixel 907, including dotting pixels 906 and 908 when the drop generator set is above pixel 907. Upon translating the printhead an increment so that the nozzle set is over pixel 908, four dots 918 are deposited, including a fourth ink dot in the lower right quadrant of the exemplary pixel 905 and dots in pixels 907 and 909. Note that at this point in the third pass, the region around exemplary pixel 905 is filled via this bi-directional scanning method. The process continues with dots 919 being deposited about pixel 909. Even though each ink ejection from simultaneously ejecting nozzles places ink dots outside of the conventional target pixel for the drop generator, the light absorption of the resulting printed matter is maintained when all of the dots from all of the scans are placed upon the medium. While the preferred embodiment described above places all of the ejected droplets outside of the target pixel, the present invention need not be so limited. A majority of the droplets are to be directed to place dots outside the target pixel but it is also within the scope of the present invention to direct some of the droplets toward the target pixel in addition to those directed outside the target pixel.

Each of the droplets of a simultaneously ejected set produces a dot having a light absorption value of approximately one divided by the number of droplets per ink ejector multiplied by the absorption value of a conventional drop in the target pixel, given the same ink. That is, $A_d \cong (1/n) \cdot A_c$, where n is the number of droplets simultaneously ejected per ink ejector and $A_c$ is the absorption of a conventionally placed drop in the target pixel, when $area_{dot} \leqq (1/n) \cdot P_a$, The positioning of the ink droplets as they are deposited upon the medium, in a preferred embodiment, are structured to give special results which enhance printing characteristics and eliminate Moiré patterns and hue shifts which otherwise can occur. In an example of four nozzles per ink ejector, it is advantageous to array the droplets in a square centered on the center of the pixel, with the droplets deposited outside of the pixel. Even for a monochrome image, it is desirable to rotate the square array so that its edges are neither parallel nor diagonal to the paper motion axis nor diagonal to the printhead scan axis. Further, color images have less grain and banding artifacts when the ink ejectors are rotated at different angles, as will be seen later.

A first preferred embodiment of a partial orifice plate array 501 of four nozzle ink drop generators is shown in FIG. 5 (three sets of a total array), referred to hereinafter as a "right rotated quad architecture." Note that in the preceding exemplary embodiments (as in the Manini reference), the nozzles 407, 409, 411, 413 are all oriented in quadrants orthogonally set about a geometric center point of the resistor 403 (viz., the geometric center point of the drop generator and relative to the scan axis, X, and the print axis, Y) and all of the droplets fall completely within the target pixel. As shown in FIG. 5, it has been found that rotating away from this orthogonal orientation of the layout has distinct advantages such as lowering the amount of short range order in a printed picture resulting in less observability of slight linefeed imperfections or misdirected nozzle ejections. This design is also more tolerant of bidirectional printing because it camouflages the artifacts of bidirectional printing. Moreover, note that the array also has each column of drop generators offset with respect to the Y-axis, arrow 119. (The purpose and methodology of such offsets is taught by U.S. Pat. No. 4,812,859 to Chan et al. for a "Multi-Chamber Ink Jet Recording Head for Color Use", assigned to the assignee of the present invention.) A primary advantage is that such a configuration will allow bidirectional X-axis printing, doubling the effective throughput.

Figure 6A:
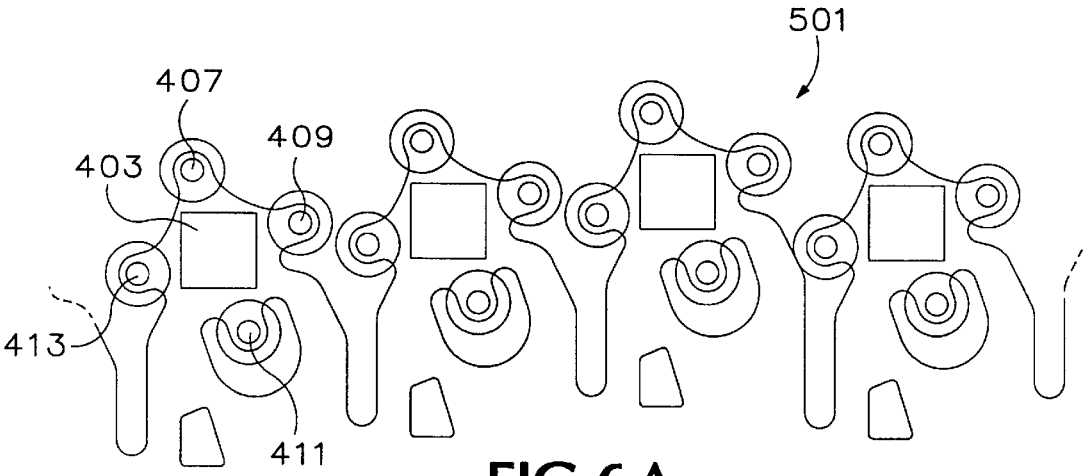
FIGS. 6A and 6B are schematic drawings (top view) of the embodiment of the present invention as shown in FIG. 5 with FIG. 6B showing in comparison to FIG. 6A, a counter rotational orientation of the nozzle sets.
Figure 6B:
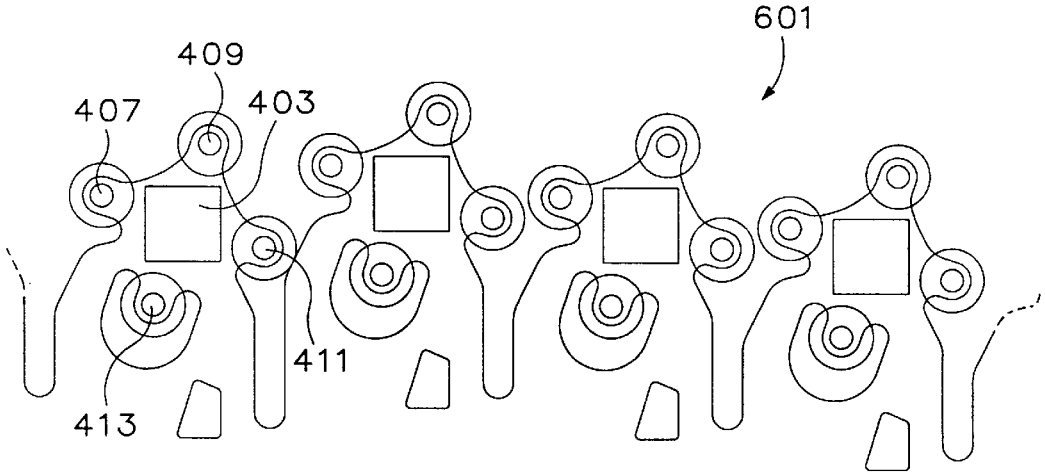

While FIGS. 5 and 6A show a right rotated quad architecture of the nozzles around the central heating element, FIG. 6B demonstrates a left rotation of the nozzles 407–413"about the centrally located heating elements 403–403". As will be demonstrated hereinafter, it has been found that combinations of rotations and the use of different rotations affects print quality by reducing clustering of two secondary colors near each other, which clustering results in a very dark spot with nearby white, thereby giving a grainy appearance. Having different patterns for each color results in a more frequent placement of, for example, cyan and magenta adjacent to each other rather than atop each other in a mid-density blue tone. This results in less grainy sky images, in the present example. Similar effects occur in mid-range flesh tones employing magenta and yellow.

Figure 7:
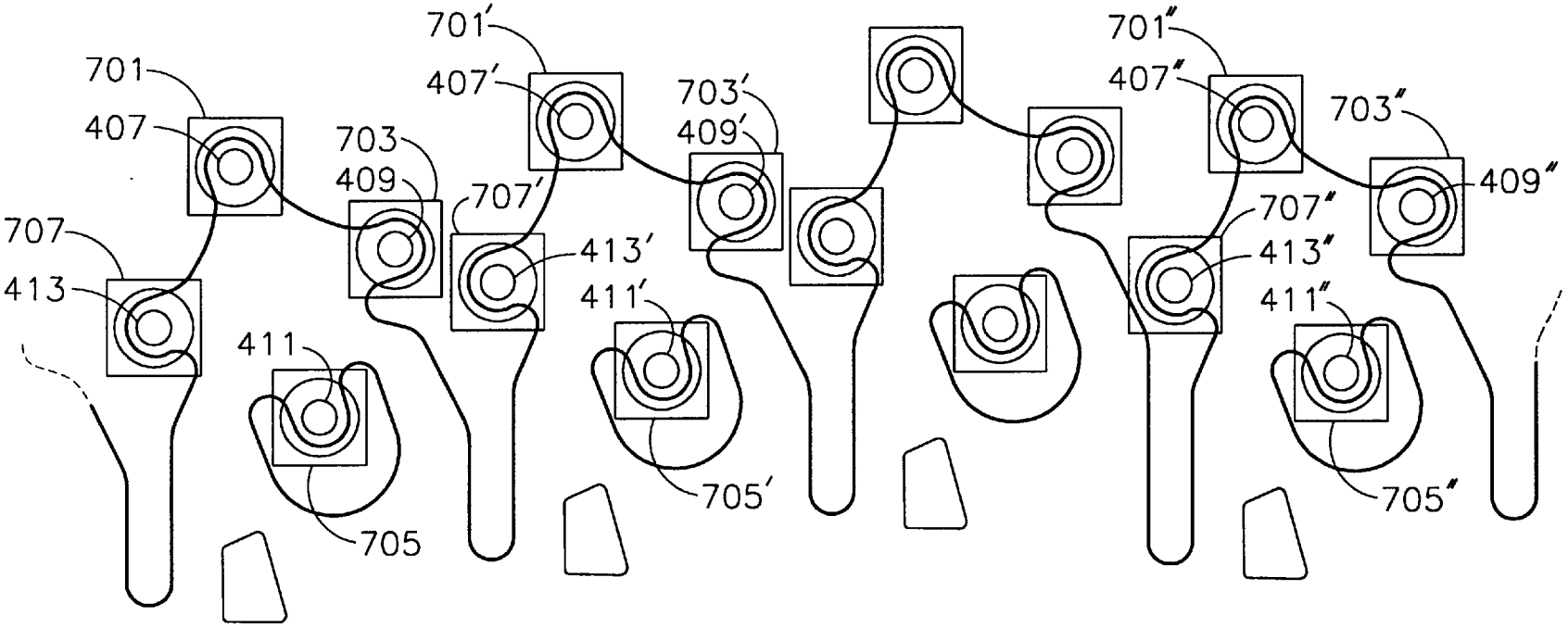
FIG. 7 is schematic drawing (top view) of a set of three, four nozzle, four heating element, inkjet drop generators (a portion of a full array) in accordance with an alternative embodiment of the present invention as shown in FIG. 5.

FIG. 7 depicts an alternative embodiment where ink drop generators similar to FIG. 5 are employed with each nozzle 407–413" having a separate heating element $\mathbf{403}_1$'–$\mathbf{403}_4$' through $\mathbf{403}''_4$. With this arrangement and using dot matrix manipulation, individual heating element electrical connections, and addressing algorithm techniques, it is possible to fire less than all nozzles at the same time. This would allow fine tuning of the image resolution.

Figure 8:
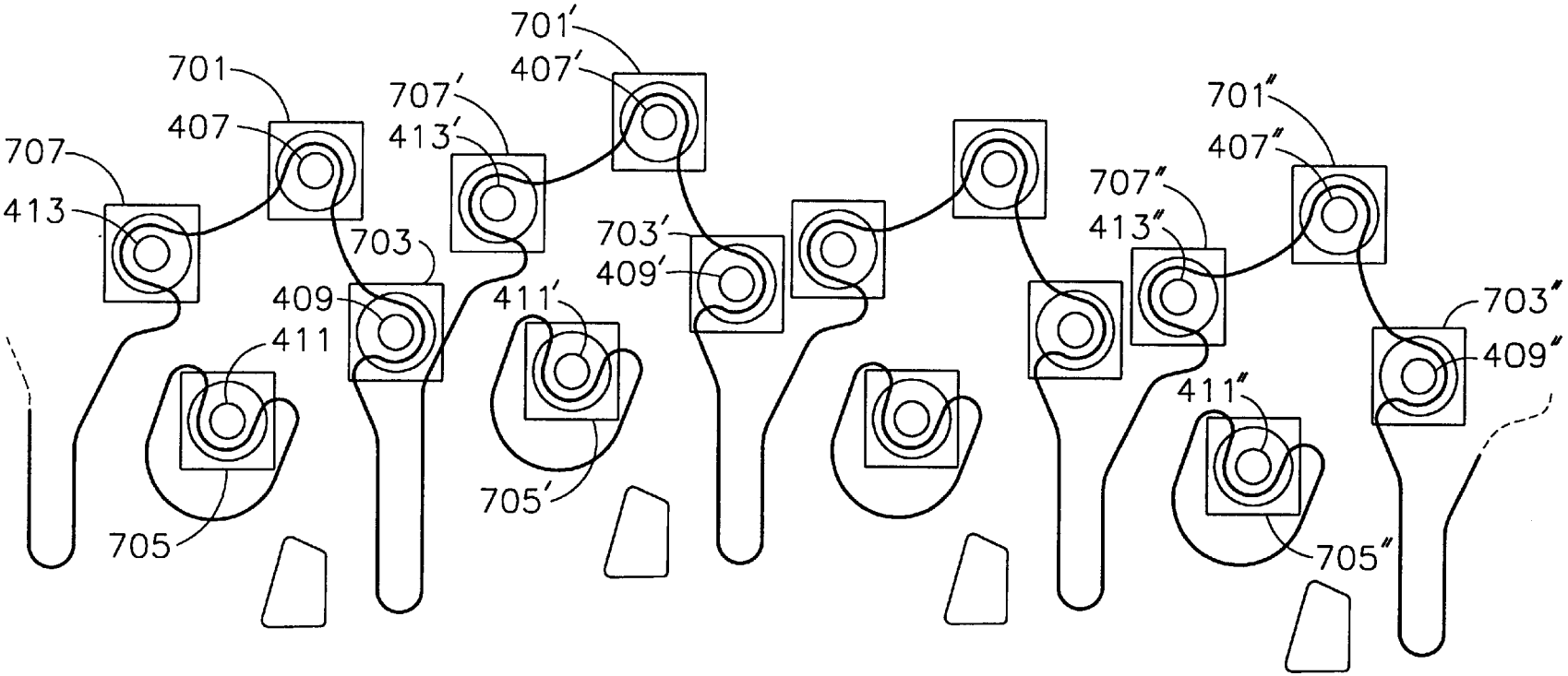
FIG. 8 is a schematic drawing (top view) of the embodiment of the present invention as shown in FIG. 7 with a counter rotational orientation of the nozzles.

While FIG. 7 shows a right rotation about a geometric center point of the drop generator indicative of the intersection of planes parallel to the X and Y axes, FIG. 8, demonstrates a left rotation of the nozzles 407–413" and the individual heating elements $\mathbf{403}_1$'–$\mathbf{403}_3$".

Visiting again FIGS. 9A–9C to discuss a particular example for a preferred embodiment, the contiguous set of pixels, 901–909, from a full grid overlay of an image are to be printed. It should be understood that in a commercial embodiment, the firing will be algorithmically controlled and that some or all of the selected sets of nozzles in the array will fire four ink droplets of an appropriate color during each scan in the X-axis (arrow 115), creating a printhead array wide swath equal to the length of the array in the Y-axis (arrow 119) in accordance with the firing signals generated by the print controller; for example, this could be a one inch or smaller pen swath up to a page length swath.

Assume a central pixel 905 of this grid subsection, having square dimensions of one three-hundredth of an inch (1/300 inch)$^2$, is to be covered with yellow ink. Also assume that the printhead employs only one ink ejector with four ink ejecting nozzles. (This implementation is assumed for simplicity of discussion—it is expected that a commercial printhead will have a plurality of ink ejectors). As shown in FIG. 9A, in the first scan pass, for example left to right along the X-axis, "pass$_1$", four ink droplets are fired in the Z-axis to be deposited as dots 911 about pixel 901 in accordance with instructions from the controller from one set of nozzles (e.g. nozzles 407", 409", 411", 413" as shown in FIG. 5). Note that at this firing, due to the rotated quad architecture, ink dots 911 are deposited in pixels 902 and 906 and in two pixels outside the exemplary grid area 901–909. Upon movement of the printhead 1/300 inch in the X axis 115 so that the nozzle set is traversing appropriately in a relative position with respect to pixel 902, four dots 912 are deposited, including a first ink dots in the upper left quadrant of the exemplary yellow pixel 905 and dots in pixels 901 and 903. Upon moving the printhead 1/300 inch so that the nozzle set is over pixel 903, four dots 913 are deposited, including dots in pixels 902 and 904. At the end of pass$_1$, with a media shift in the Y-axis 119, a second swath can be printed during a next scan pass across the print medium. (A commercial implementation having a plurality of ink ejectors on a printhead deposits dots into adjacent pixels such that a single column of adjacent pixels essentially as wide as the printhead will have dots deposited simultaneously, or nearly simultaneously, from independently activated ink ejectors).

FIG. 9B depicts a second pass, from right to left, pass$_2$, that first deposits four ink dots 914 about pixel 904, including an ink dot in the upper right quadrant of the target pixel and dots in pixels 903 and 909. Upon movement of the printhead 1/300 inch so that the nozzle set is over the exemplary pixel 905, four dots 915 are deposited, including dots in the pixels 902, 904, 906 and 908. Upon moving the printhead another 1/300 inch so that the nozzle set is over pixel 906, four dots 916 are deposited, including a third ink dots in the lower left quadrant of the exemplary pixel 905, and dots in pixels 901 and 907.

FIG. 9C depicts a third pass, from left to right, pass$_3$. Four ink dots 917 are deposited about pixel 907, including placement in pixels 906 and 908 when the drop generator set is above pixel 907 in the Z axis (FIG. 1, arrow 117). Upon moving the printhead 1/300 inch so that the nozzle set is over pixel 908, four dots 918 are deposited, including a fourth ink dots in the lower right quadrant of the exemplary pixel 905 and dots in pixels 907 and 909. The process continues with drops 919 being deposited about pixel 909.

It has been further discovered, that print quality is improved when a combination of different nozzle rotations orientation is used which also may be important for meeting mechanical tolerances during manufacture of the printhead. For example, assume a CMYK inkjet hard copy apparatus employs one tri-color print cartridge for CMY inks with subsets of the array of nozzles each coupled to specific color ink reservoir and a separate black ink print cartridge (e.g., a standard, single nozzle configuration). When the nozzle set array for cyan ink is left-rotated such as shown in FIG. 6B and the nozzle set arrays for magenta and yellow inks are respectively right rotated as shown in FIGS. 5 and 6B, an improvement in print quality is achieved.

Figure 11A:
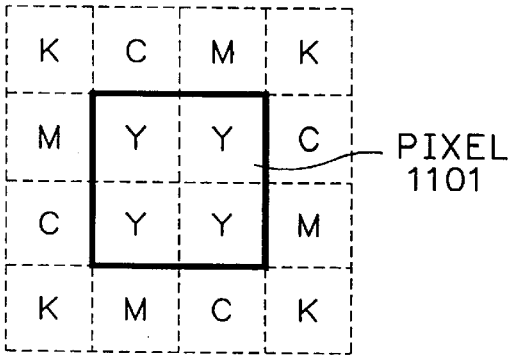
FIGS. 11A and 11B depict a superimposed schematic of nozzle patterns overlaid on a target pixel.

To demonstrate the achievement of improved print quality in accordance with the present invention, color samples of a facial image, eye region, are provided as FIGS. 11A–10D. These figures are a plain paper copy of a subsection prints and at a ten times magnification. The eye and a band of yellow makeup shown was each created from an original image by using four different computer generated virtual printing methodologies and the comparison prints made using a Hewlett-Packard DeskJet™ printer, model 850. FIG. 10A is a rendering of such a sample print as can be made with a conventional single nozzle printhead, 300 dpi printer; FIG. 10B from a print made on a conventional single nozzle printhead, 600 dpi printer; FIG. 10C from a print produced by experimental computer modeling using a 300 dpi printhead in accordance with the present invention using a nozzle layout configuration for CMYK inks in a right rotated quad architecture ("CMYK R-RotQuad") as shown in FIG. 5; and, FIG. 10D from a 300 dpi printhead in accordance with the present invention using nozzle array layout configuration for cyan ink in a left rotated orientation ("CL-") as shown in FIG. 6B and magenta and yellow inks nozzle array layout configurations in a right rotated architecture ("MYK-R-RotQuad") as shown in FIG. 5.

FIG. 10A shows a noticeable grain; that is, even in the highest resolution area of the iris, individual dots are very apparent to the unaided eye. Only in the center of the pupil, where black saturation is achieved, do the individual dots disappear. Luminance transition regions, e.g., above the eyeball and to the viewer's right side where yellow dots are dominant, are discontinuous rather than smooth (compare FIG. 10B).

FIG. 10B shows a high resolution, 600 dpi, print with rich color saturation, smooth tonal transition, and markedly reduced granularity, with the reduced size individual dots showing quantization effects mostly in transition zones toning and the whites of the eyes.

Comparing FIG. 10C to FIGS. 10A and 10B, it can immediately be recognized that the overall print quality appears to be closer to the high-resolution 600 dpi print of FIG. B than it does to FIG. 10A. A marked reduction in overall graininess is obvious. Richer hues are perceived and luminance ratios are improved.

Comparing FIG. 10D to FIGS. 10A and 10B, the same observations can be made as were made with respect to FIG. 10C. While FIGS. 10C and 10D are very close to each other in overall print quality, FIG. 10D has an overall sharpness that appears to be closer to FIG. 10B; in other words, the resolution appears to be slightly closer to the 600 dpi sample print.

The counter rotation of some color ink designated drop generators provides the advantage of more quantization error reduction. As an example, note that FIG. 10D has less noticeable diagonal banding in the "white flash region" of the iris than does FIG. 10D. This technique also is effective at masking Moiré patterns (an undesirable banding artifact in which, for example, two patterns having a different periodicity and/or orientation are overlain) that might result from color plane misalignment as the printhead traverses the medium, possibly in successive passes. Alternate designs may employ three separate rotations of the CYM inks to further optimize print quality and eliminate unwanted repeating patterns such are Moiré patterns. Additional nozzle placements and orientations may also be employed within a single color to further optimize print quality.

An example of a specific advantageous printing scheme is shown in FIG. 11A. A combination of nozzle rotations in a printhead is shown in order to direct four yellow ink droplets, represented by capital Y's in the drawing, toward a target pixel 1101 with other drops falling in accordance with a right rotated cyan nozzle cluster, represented by capital C's, a left rotated magenta nozzle cluster, represented by capital M's, and black placed at the outermost corners fired from a separate printhead. This arrangement is desirable because it reduces granularity in the printed image. Yellow ink generally has the lowest luminance and would have less perceived granularity due to the four yellow droplets located at the pixel center.

FIG. 11A illustrates a superimposed schematic of the nozzle patterns for the ink ejectors for cyan (C), magenta (M), yellow (Y), and black (K) overlaid on a target pixel 1101. As an example, the cyan ejector employs only cyan nozzles in the positions shown. The other colors are arranged similarly. This design, at least for cyan and magenta, resembles the rotated and counter rotated quads patterns of FIG. 6. Note that, when printing, if the cyan pattern were displaced to the right relative to, for example the magenta pattern, in the horizontal direction by one-half of a dot row, the top C-M pair would overlap less and the bottom pair would overlap more thereby resulting in no hue shift. The same is true for all color pairs employing this improvement. At the same time, overall granularity is reduced in mid tones because there are no large regions of overlapping colors.

Figure 11B:
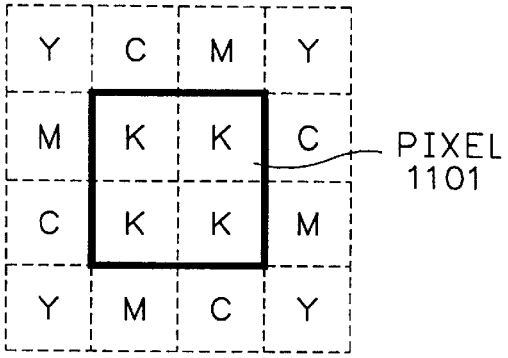

FIG. 11B has the same properties as FIG. 11A with regard to hue shift and granularity reduction, but places black at the center of the pixel. This allows one to print high spatial frequencies of black. Since composite black is far more frequently used in images than true black, one can have low granularity mid tones and sharp text and edges. It is possible that a printhead depositing a conventional single block dot within pixel 1101 would be used, for example, to avoid nozzle clogging by pigment-colored black ink or to obtain better black acuity. Nevertheless, a preferred embodiment employs a multiple nozzle black ink ink ejector.

Figure 12A:
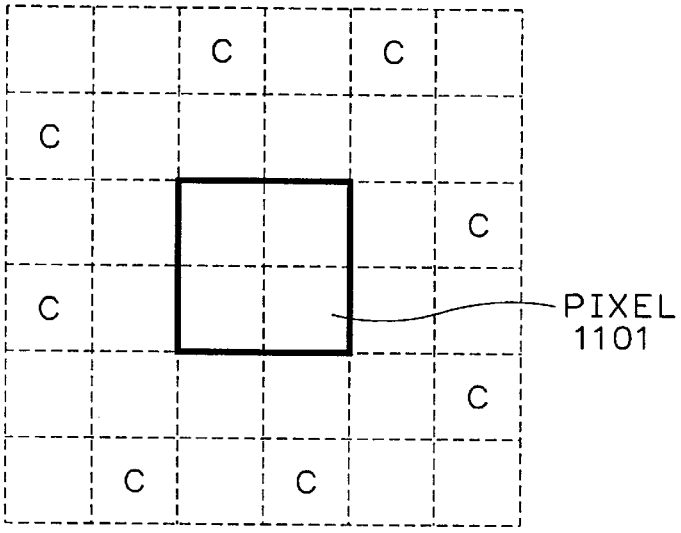
FIGS. 12A, 12B, 12C, 12D, and 12E demonstrate a more complex exemplary printhead nozzle orientation strategy in comparison to FIGS. 11A–11B.
Figure 12B:
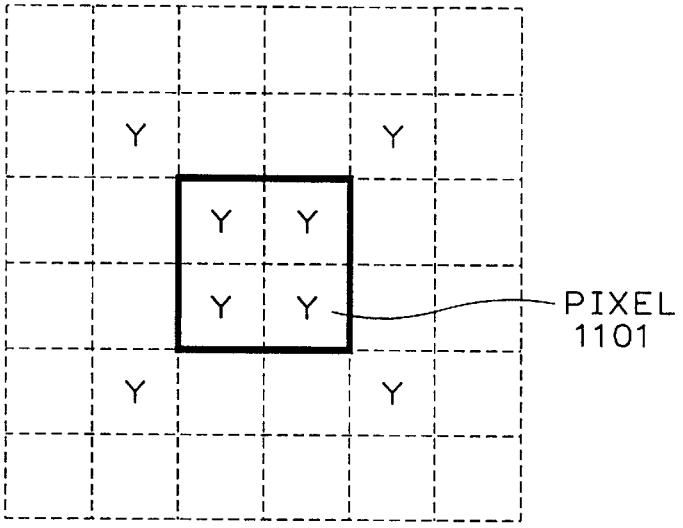
Figure 12C:
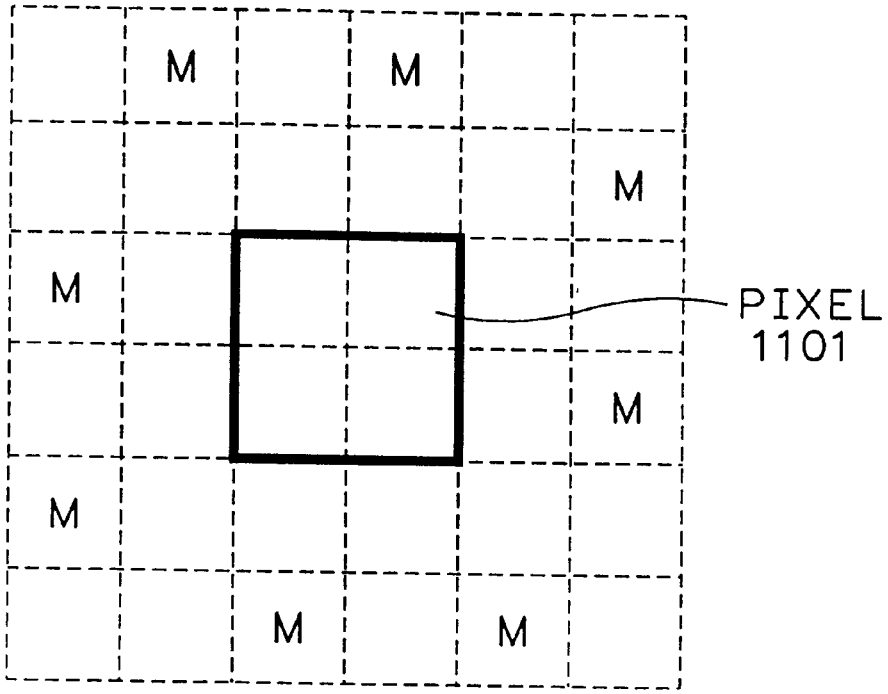
Figure 12D:
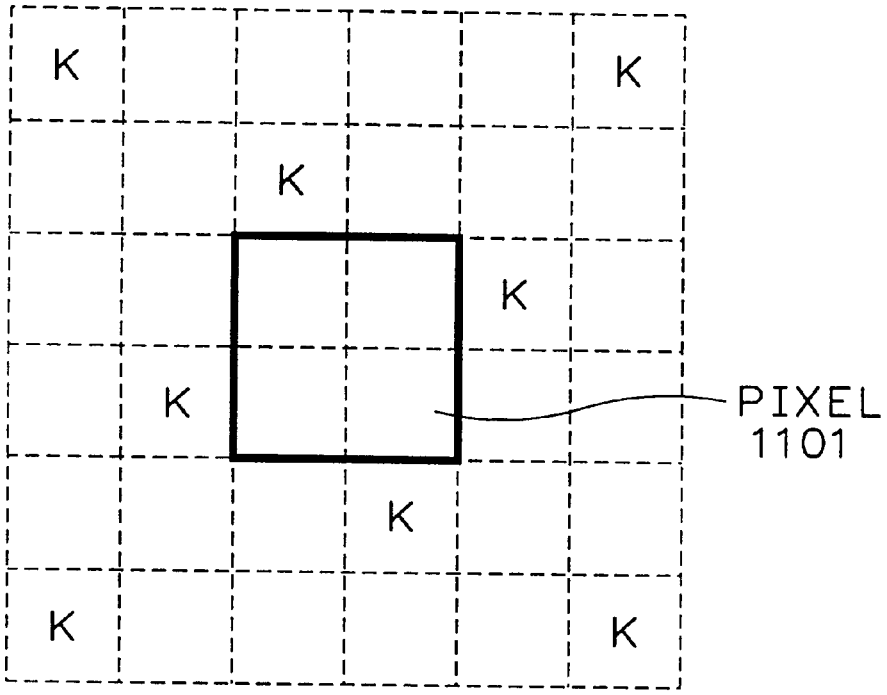
Figure 12E:
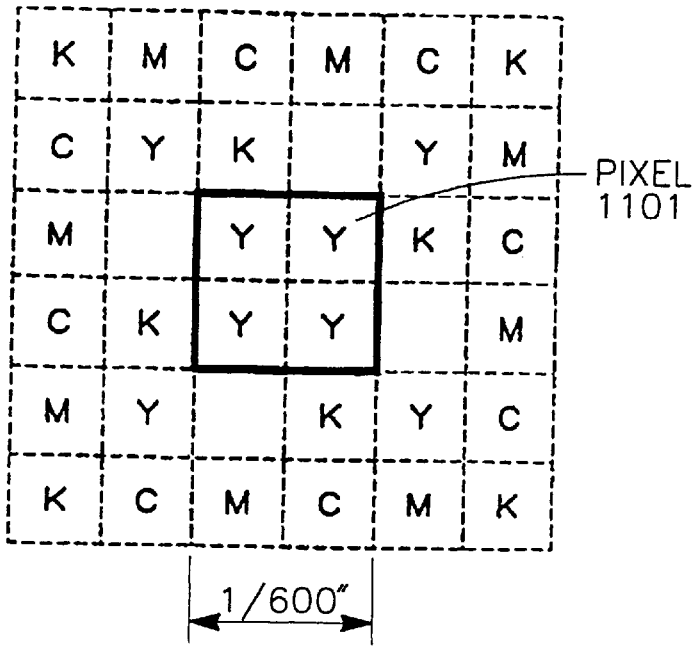

FIGS. 12A through 12E demonstrates an example of the more complex implementation scheme which can be devised in accordance with the present invention. FIGS. 12A through 12D show that as scanned, an appropriately constructed printhead can lay down super pixels in patterns such that as consecutive rows are printed, the super pixels are layered, C, Y, M, K to produce a pattern as shown in FIG. 12E. Actual nozzle firing and dot deposition will of course be based on the image being duplicated.

The present invention speeds throughput significantly due to the decreased nozzle size since refill time is proportional to the capillarity force which is inversely proportional to the radius of the bore of the nozzle. In the state of the art, a 300 dpi inkjet printer operates at about five kHz, a 600 dpi printer operates at about twelve kHz. The deposition of the smaller droplets in accordance with the apparatus and method of the present invention (for example, having individual drop volumes equivalent to a 1200 dpi hard copy printer) is estimated to allow operating at approximately 30 kHz at 300 dpi but without the need for high data rates that multi-drop mode, high resolution printing requires.

Figure 13:
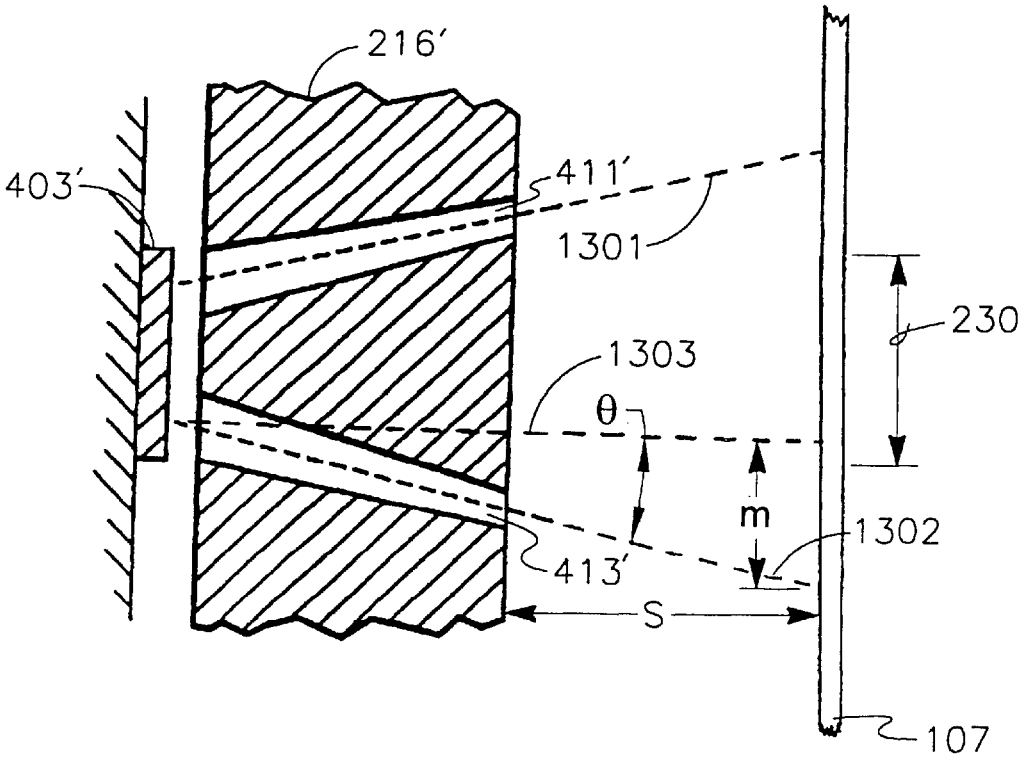
FIG. 13 is an alternative embodiment of an ink drop generator in cross-section of the present invention similar to that shown in FIG. 4A.

FIG. 13 depicts a cross section of an alternative drop generator taken at a similar location as section line A—A of FIG. 3B. In FIG. 13 the axes, or boresights 1301, 1302, of the nozzles 411', 413' are angled away from a perpendicular 1303 from the plane of heater resistor 403' by an ejection angle θ. An ink droplet ejected from each of the angled nozzle results in a dot on the medium displaced from the normal by a distance, m, and therefore places the dot outside of the target pixel 230. In a preferred embodiment consistent with the dot placement of FIGS. 9A–9C, the medium to the nozzle exit spacing, S, of 40 mils, and the manifold thickness, t, of approximately 25 μm, the ejection angle θ is approximately 2° consistent with FIG. 14 but can vary depending upon the distance of the ejecting nozzle boresight from the centerline of the ink ejecting heater resistor centerline. It is expected that alternative embodiments will efficiently utilize ejection angle θ values ranging from 0° to 10°. Other techniques of causing the expelled droplet from each ejecting nozzle to deviate from a direction of flight perpendicular to the surface of the orifice plate of the printhead may also be used. In addition to the diverging nozzles, a nozzle asymmetry or a distortion in the nozzle opening having a sharp radius of curvature, or a radial notch in the outer surface opening of the nozzle may be used to disperse the dots in and around the target pixel.

Figure 14A:
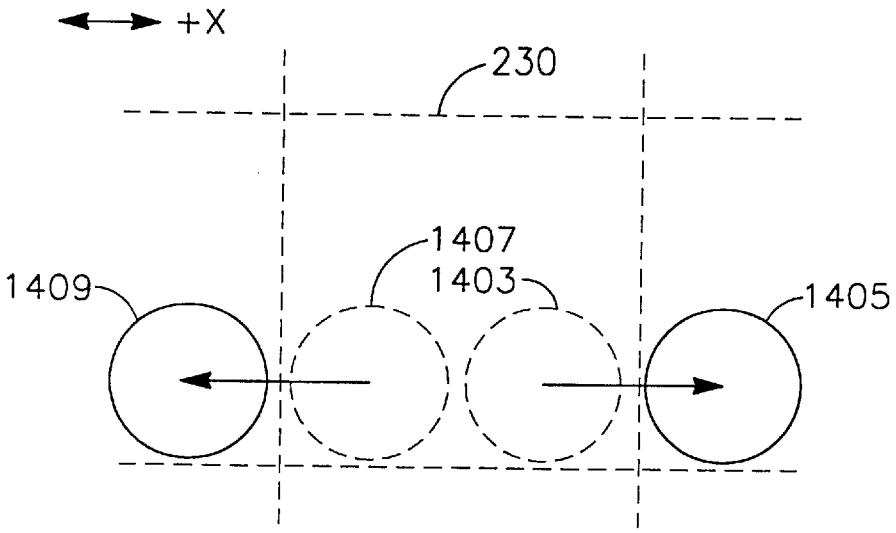
FIGS. 14A and 14B are planar views of the printed surface of a print medium, illustrating an exemplary placement of print dots.
Figure 14B:
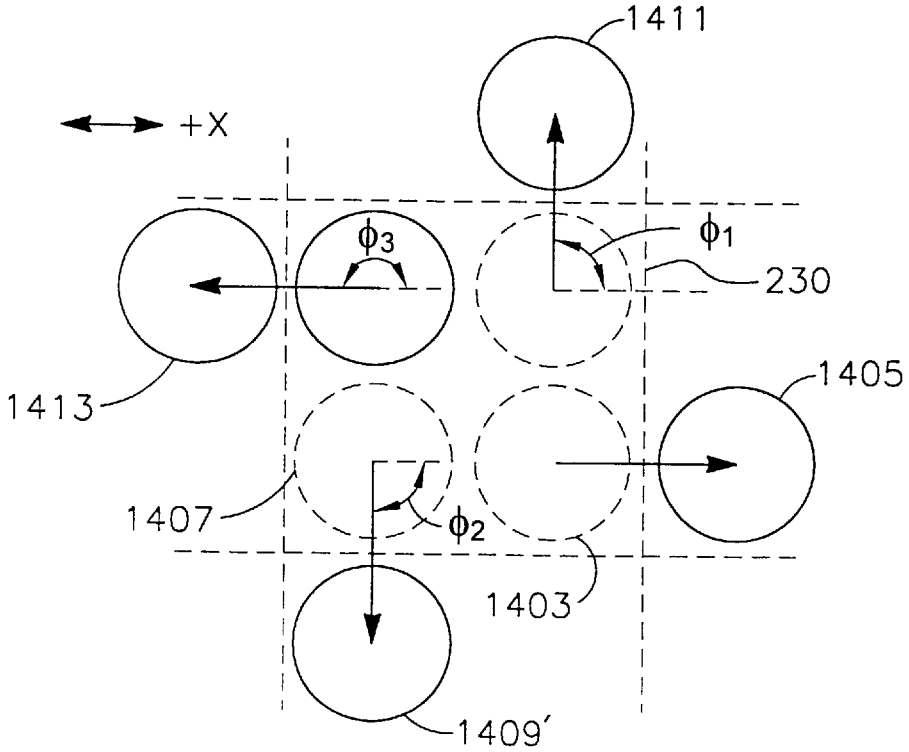

The resulting dots deposited on the medium are depicted in FIG. 14A. One target pixel 230 is shown in full in broken line. Portions of the adjacent pixels are also shown. A normally positioned ink dot placed within pixel 230 is illustrated in broken line and referenced as 1403.

As a result of the angled nozzle of FIG. 13, the ink dot is actually placed as shown as dot 1405. Likewise, a normal placement of dot 1407 is, as a result of the angled nozzle, deposited as dot 1409. Quad rotation, as described above, is realized by moving the direction ejection angle θ takes from the scan axis, X. As illustrated in the dot deposition of FIG. 14B, the nozzle ejecting the droplet in the placement of dot 1405 is angled in the direction of +X; the nozzle ejecting the droplet resulting in dot 1409' is angled in the direction, translation angle $\phi_1$, of −90° from +X; the nozzle ejecting the droplet resulting in dot 1411 is angled in the direction, $\phi_2$, of +90° from +X; and the nozzle ejecting the droplet resulting in dot 1413 is angled in the direction, $\phi_3$, of +180° from +X (i.e., −X). Of course, other increments of rotation, both positive and negative as well as values which place the dots within the target pixel, can be utilized to place dots in a manner which provides useful print characteristics.

The present invention also decreases printhead operating temperature problems. Each heating element will fire more ink drops per cycle. The printhead will tend to get hotter in conventional multi-drop modes in accordance with the formula:

$$T_e = E_{drop}(M_{drop} \cdot C_p),$$

where $T_e$ represents the characteristic temperature rise over ambient of the printhead, E is the energy required to eject a drop, M is the total drop mass per ink ejector firing, and $C_p$ is specific heat. It has been found that in previous high resolution printing, e.g., 1200 dpi, as the ink drops decrease in mass the energy requirement has not decreased proportionally, leading to temperature excursions over 70° C.—unacceptable for reproducible print quality. Use of the present invention for improved temperature performance allows the desirable temperature characteristics of large drop print cartridges and printheads to be realized while obtaining the granularity improvement characteristic of small droplet print cartridges and printheads.

In accordance with the foregoing description, the present invention provides a printhead design and ink drop deposition methodology using that design which provides superior print quality while employing techniques generally associated with low resolution inkjet printing. Printhead mechanical and electrical operational requirements are also facilitated.

The foregoing description of the preferred embodiment of the present invention has been presented for purposes of illustration and description. It is not intended to be exhaustive or to limit the invention to the precise form disclosed.

Obviously, many modifications and variations will be apparent to practitioners skilled in this art.

Clearly, a set of nozzles per each drop generator is not limited to two, three or four. For example, where an ink composition is designed for lateral spreading, where the intent is to cover a region uniformly with as little ink as possible, a hexagonal array reduces the total ink deposited by approximately thirty percent. Thus, a combination of using some hexagonal sets of nozzles used for a black filled area with other configurations for other color inks can be designed into specific printheads.

Moreover, the present invention has been described in terms of a typical, commercial, scanning inkjet apparatus. However, page width and page length printheads are also feasible in the state of the art and the invention is adaptable to those implementations.

Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated.

We claim:

1. An inkjet printhead having an array of drop generators for ejecting ink to form dots on a print medium, comprising:

a plurality of ink ejecting nozzles associated with one drop generator of the array of drop generators such that each nozzle of said plurality of ink ejecting nozzles ejects an ink droplet essentially simultaneously when said one drop generator is activated; and said plurality of ink ejecting nozzles arranged to direct each droplet ejected during a first activation of said one drop generator toward the print medium and to place a majority of resultant dots on the print medium outside a target pixel disposed opposite said one drop generator.

2. An inkjet printhead in accordance with claim 1 wherein said plurality of ink ejecting nozzles are further arranged to place each said resultant dot on the print medium such that each resultant dot has a light absorption value essentially equal to the product of the dividend of one divided by the number of nozzles in said plurality of nozzles and a light absorption value of a single dot covering an area equal to the area of a target pixel.

3. An inkjet printhead in accordance with claim 1 wherein said plurality of ink ejecting nozzles are further arranged to place each said resultant dot on the print medium such that each resultant dot has a light absorption value essentially equal to the difference of a single dot covering an area equal to said area of said target pixel less the sum of light absorbtion values from all other resultant ink dots deposited on the print medium.

4. The inkjet printhead in accordance with claim 2 wherein said one drop generator further comprises an ink ejector;

an orifice plate in which said plurality of ink ejecting nozzles extend from an entrance port adjacent said ink ejector to an exit orifice;

wherein each nozzle of said ink ejecting nozzles has a nozzle axis defining the boresight of said nozzle and wherein a majority said nozzle axes are tilted away from a perpendicular drawn from a plane of said ink ejector by an ejection angle value whereby a majority of dots formed by droplets ejected from said nozzles of said ink ejecting nozzles are deposited on the print medium outside said target pixel.

5. The inkjet printhead in accordance with claim 4 wherein one of said inkjet printhead and the print medium are moved relative to one another in a predetermined direction, and wherein each nozzle axis of said tilted nozzle axes is tilted from said perpendicular to create a dot displaced outside said target pixel by a distance related to said ejection angle at a translation angle, $\phi_a$, from said predetermined direction different from each other tilted nozzle axis.

6. The inkjet printhead in accordance with claim 5 wherein said printhead further comprises:

a second array of drop generators, including an ink ejector and an orifice plate in which a first plurality of nozzles extend from an entrance port adjacent said ink ejector to an exit orifice, wherein each said nozzle of said second array of drop generators has a nozzle axis defining the boresight of said nozzle and wherein a majority of said nozzle axes are tilted away from a perpendicular drawn from a plane of said ink ejector by a predetermined angle value and wherein each nozzle axis of said tilted nozzle axes is tilted from said perpendicular to create a dot displaced outside said target pixel by a distance related to said ejection angle at a second translation angle, $\phi_b$, from said predetermined direction different from each other tilted nozzle axis;

a second plurality of nozzles associated with one drop generator of said second array of drop generators such that each nozzle of said second plurality of nozzles ejects an ink droplet essentially simultaneously when said one drop generator of said second array of drop generators is activated;

said second plurality of nozzles arranged to direct each droplet ejected during a first activation of said one drop generator of said second array of drop generators toward the print medium to place a majority of dots on the print medium outside said target pixel, and each said dot placed on the print medium having a light absorption value essentially equal to the product of the dividend of one divided by the number of nozzles in said second plurality of nozzles and a light absorption value of a single dot covering the area of a target pixel.

7. An inkjet printhead having an array of drop generators for ejecting ink to form dots on a print medium, comprising:

a first drop generator of the array of drop generators, including an ink ejector and an orifice plate; and a plurality of ink ejecting nozzles extending through said orifice plate from an entrance port adjacent said ink ejector to an exit orifice, each nozzle of said plurality of ink ejecting nozzles having a nozzle axis defining the boresight of said nozzle and a majority of said nozzle axes being tilted away from a perpendicular drawn from a plane of said ink ejector by an ejection angle value whereby a majority of dots formed by said droplets ejected from said nozzles essentially simultaneously when said first drop generator is activated are deposited on the print medium outside a target pixel.

8. The inkjet printhead in accordance with claim 7 wherein each nozzle of said plurality of ink ejecting nozzles is arranged to place a dot on the print medium having a light absorption value essentially equal to the product of the dividend of one divided by the number of nozzles in said plurality of ink ejecting nozzles and a light absorption value of a single dot covering an area equal to the area of the target pixel.

9. The inkjet printhead in accordance with claim 7 wherein one of said inkjet printhead and the print medium are moved relative to one another in a predetermined direction, and wherein each nozzle axis of said tilted nozzle axes is tilted from said perpendicular to create a dot displaced outside said target pixel by a distance related to said ejection angle at a translation angle, $\phi_a$, from said predetermined direction different from each other tilted nozzle axis.

10. The inkjet printhead in accordance with claim 9 wherein said printhead further comprises:

a second array of drop generators, each including an ink ejector and an orifice plate in which a first plurality of nozzles extend from an entrance port adjacent said ink ejector to an exit orifice, wherein each said nozzle of said first plurality of nozzles of second array of drop generators has a nozzle axis defining the boresight of said nozzle and wherein a majority of said nozzle axes are tilted away from a perpendicular drawn from a plane of said ink ejector by a predetermined angle value and wherein each nozzle axis of said tilted nozzle axes is tilted from said perpendicular to create a dot displaced outside a target pixel associated with said ink ejector by a distance related to said ejection angle at a second translation angle, $\phi_b$, from said predetermined direction different from each other tilted nozzle axis such that a majority of dots are printed outside said target pixel;

a second plurality of nozzles associated with one drop generator of said second array of drop generators such that each nozzle of said second plurality of nozzles ejects an ink droplet essentially simultaneously when said one drop generator of said second array of drop generators is activated;

said second plurality of nozzles arranged to direct each droplet ejected during a first activation of said one drop generator of said second array of drop generators toward the print medium to place a majority of dots on the print medium outside said target pixel, and each said dot placed on the print medium having a light absorption value essentially equal to the product of the dividend of one divided by the number of nozzles in said second plurality of nozzles and a light absorption value of a single dot covering the area of a target pixel.

11. The inkjet printhead in accordance with claim 7 wherein said plurality of ink ejecting nozzles equals a quantity of (n) nozzles and wherein each nozzle of said plurality of ink ejecting nozzles is arranged to place a dot on the print medium with a droplet having a drop weight of (W), the sum of the light absorptions of all of said dots placed on the print medium during a first activation of said first drop generator having a light absorption essentially equal to that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

12. The inkjet printhead in accordance with claim 7 wherein said plurality of ink ejecting nozzles equals a quantity of (n) nozzles and wherein each nozzle of said plurality of ink ejecting nozzles is arranged to place a dot on the print medium with a droplet having a drop weight of (W), the sum of the light absorptions of all of said dots placed on the print medium during a first activation of said first drop generator having a light absorption equal to or greater than that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

13. A method of depositing ink dots on a print medium from an inkjet printer comprising the steps of:

essentially simultaneously ejecting a droplet of ink from each nozzle of a plurality of ink ejecting nozzles associated with a first drop generator of an array of drop generators; and directing a majority of said simultaneously ejected droplets at the print medium to deposit ink dots on the print medium outside a target pixel, said target pixel having an area and disposed opposite said first drop generator.

14. A method in accordance with the method of claim 13 further comprising the step of creating in each said dot placed on the print medium a light absorption value essentially equal to the product of the dividend of one divided by the number of nozzles in said plurality of nozzles and a light absorption value of a single dot covering an area essentially equal to said area of said target pixel.

15. A method in accordance with the method of claim 13 further comprising the step of creating in each said dot placed on the print medium a light absorption value essentially equal to the difference of a light absorbtion value of a single dot covering an area equal to said area of said target pixel less the sum of the light absorbtion values from all other ink dots deposited on the print medium from said essentially simultaneously ejected droplets from each said nozzle associated with said first drop generator.

16. A method in accordance with the method of claim 13 wherein said step of directing said majority of droplets further comprises the step of depositing each ink dot from said majority of droplets in as many different pixels adjacent to said target pixel as there are nozzles in said first drop generator.

17. A method in accordance with the method of claim 14 wherein said step of directing said majority of droplets further comprises the steps of moving one of said inkjet printhead and the print medium relative to one another in a predetermined direction, and depositing each dot from said majority of droplets at a translation angle, $\phi_a$, from said predetermined direction different from each other deposited dot from said majority of droplets.

18. A method in accordance with the method of claim 17 further comprising the steps of:

essentially simultaneously ejecting a droplet of ink from each nozzle of a second plurality of ink ejecting nozzles associated with a second drop generator of said array of drop generators;

directing a majority of droplets from said second plurality of ink ejecting nozzles to deposit each dot from said majority of droplets from said second plurality of ink ejecting nozzles at a second translation angle, $\phi_b$, from said predetermined direction different from each other deposited dot from said majority of droplets from said second plurality of ink ejecting nozzles; and creating in each said dot deposited on the print medium a light absorption value essentially equal to the product of the dividend of one divided by the number of nozzles in said plurality of ink ejecting nozzles and a light absorption value of a single dot covering an area essentially equal to the area of said target pixel.

19. A method of inkjet printhead manufacture in which the printhead employs an array of drop generators to eject ink to form dots on a print medium, comprising the steps of:

forming a first drop generator of the array of drop generators from an ink ejector and an orifice plate;

extending a plurality of nozzles associated with said first drop generator through said orifice plate from an entrance port adjacent said ink ejector to an exit orifice said plurality of nozzles arranged to essentially simultaneously eject ink when said ink ejector is activated, each nozzle of said plurality of nozzles having a nozzle axis defining the boresight of said nozzle; and tilting a majority of said nozzle axes away from a perpendicular drawn from a plane of said ink ejector by at least one ejection angle value so that a majority of said dots formed by droplets ejected essentially simultaneously from said majority of nozzles of said first drop generator when said first drop generator is activated are deposited on the print medium outside said target pixel.

20. A method in accordance with the method of claim 19 further comprising the step of tilting each said nozzle axis of said majority of tilted nozzle axes from said perpendicular to create a dot displaced outside said target pixel by a distance related to said at least one ejection angle at a translation angle, $\phi_a$, from a predetermined direction of movement of said inkjet printhead and the print medium relative to one another, each nozzle axis being tilted in a direction different from each other tilted nozzle axis.

21. A method in accordance with the method of claim 20 further comprising the steps of:

forming a second array of drop generators from second ink ejectors and said orifice plate;

extending a second plurality of ink ejecting nozzles associated with one drop generator of said second array of drop generators from an entrance port adjacent an ink ejector of said second ink ejectors to an exit orifice, wherein each said nozzle of said one drop generator of said second array of drop generators has a nozzle axis defining the boresight of said nozzle; and tilting a majority of said nozzle axes away from a perpendicular drawn from a plane of said ink ejector of said second ink ejectors by said at least one ejection angle value and tilted from said perpendicular to create a dot displaced outside said target pixel by a distance related to said at least one ejection angle at a second translation angle, $\phi_b$, from said predetermined direction different from each other tilted nozzle axis such that drops ejected from each said tilted nozzle upon an activation of said ink ejector of said second ink ejectors are deposited as dots outside said target pixel.

22. A method of manufacture in accordance with the method of claim 19 further comprising the step of tilting a majority of said nozzle axes such that each said dot placed on the print medium is provided a light absorption value essentially equal to the product of the dividend of one divided by the number of nozzles in said second plurality of ink ejecting nozzles and the light absorption value of a single dot covering the area of a target pixel.

23. A method of manufacture in accordance with the method of claim 19 wherein said plurality of nozzles equals a quantity of (n) nozzles and further comprising the step of tilting a majority of said nozzle axes such that each nozzle of said quantity of nozzles is arranged to place a dot on the print medium with a droplet having a drop weight of (W), the sum of the light absorptions of all of said dots placed on the print medium during a first activation of said first drop generator having a light absorption essentially equal to that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

24. A method of manufacture in accordance with the method of claim 19 wherein said plurality of nozzles equals a quantity of (n) nozzles and further comprising the step of tilting a majority of said nozzle axes such that each nozzle of said quantity of nozzles is arranged to place a dot on the print medium with a droplet having a drop weight of (W), the sum of the light absorptions of all of said dots placed on the print medium during a first activation of said first drop generator having a light absorption equal to or greater than that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

25. An inkjet printhead having an array of drop generators for ejecting ink to form dots on a print medium, comprising:

a quantity of ink ejecting nozzles equal to (n) and associated with one drop generator of the array of drop generators such that each nozzle of said quantity of ink ejecting nozzles ejects an ink droplet having a drop weight equal to (W) essentially simultaneously when said one drop generator is activated;

said quantity of ink ejecting nozzles arranged to direct droplets ejected during a first activation of said one drop generator toward the print medium to place a majority of dots on the print medium outside a target pixel disposed opposite said one drop generator, and the sum of the light absorptions of all said dots placed on the print medium during said first activation of said one drop generator having a light absorption essentially equal to that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

26. The inkjet printhead in accordance with claim 25 wherein said one drop generator further comprises an ink ejector;

an orifice plate in which said quantity of ink ejecting nozzles extend from an entrance port adjacent said ink ejector to an exit orifice;

wherein each nozzle of said ink ejecting nozzles has a nozzle axis defining the boresight of said nozzle and wherein a majority of said nozzle axes are tilted away from a perpendicular drawn from a plane of said ink ejector by an ejection angle value whereby each dot formed by a droplet ejected from each tilted nozzle of said ink ejecting nozzles is deposited on the print medium outside said target pixel.

27. The inkjet printhead in accordance with claim 26 wherein one of said inkjet printhead and the print medium are moved relative to one another in a predetermined direction, and wherein each said nozzle axis of said tilted nozzle axes is tilted from said perpendicular to create a dot displaced outside said target pixel by a distance related to said ejection angle at a translation angle, $\phi_a$, from said predetermined direction different from each other tilted nozzle axis.

28. The inkjet printhead in accordance with claim 27 wherein said printhead further comprises:

a second array of drop generators, each including an ink ejector and an orifice plate in which a first plurality of ink ejecting nozzles extend from an entrance port adjacent said ink ejector to an exit orifice, wherein each said nozzle of said second array of drop generators has a nozzle axis defining the boresight of said nozzle and wherein a majority of said nozzle axes are tilted away from a perpendicular drawn from a plane of said ink ejector by an ejection angle value and wherein each nozzle axis of said tilted nozzle axes is tilted from said perpendicular to create a dot displaced outside said target pixel by a distance related to said ejection angle at a second translation angle, $\phi_b$, from said predetermined direction different from each other tilted nozzle axis;

a second quantity of nozzles ($n_2$) associated with one drop generator of said second array of drop generators such that each nozzle of said second quantity of nozzles ejects an ink droplet having a drop weight equal to ($W_2$) essentially simultaneously when said one drop generator of said second array of drop generators is activated;

said second quantity of nozzles arranged to direct each droplet ejected during a first activation of said one drop generator of said second array of drop generators toward the print medium to place a majority of dots on the print medium outside said target pixel, and the sum of the light absorptions of all said dots placed on the print medium during said first activation of said one drop generator of said second array of drop generators having a light absorption essentially equal to a single dot produced on the print medium by one drop having a drop weight equal to ($n_2 \cdot W_2$) but a sum of the light absorptions of dots placed in any pixel on the print medium during said first activation of said one drop generator of said second array of drop generators being less than said single dot produced on the print medium by said one drop having a drop weight equal to ($n_2 \cdot W_2$).

29. A method of depositing ink dots on a print medium from an inkjet printer comprising the steps of:

essentially simultaneously ejecting a droplet of ink having a drop weight equal to (W) from each nozzle of a quantity of (n) ink ejecting nozzles associated with an activation of one drop generator of an array of drop generators;

directing each said droplet at the print medium to deposit an ink dot having a light absorption on the print medium, a majority of said droplets depositing ink dots outside a target pixel disposed opposite said one drop generator; and creating a sum of light absorptions of all said dots deposited on the print medium from said essentially simultaneously ejected droplets of ink from said one drop generator essentially equal to that of a single dot produced on the print medium by one drop having a drop weight equal to ($n \cdot W$) but a sum of the light absorptions in any pixel of dots placed on the print medium from said essentially simultaneously ejected droplets of ink from said one drop generator being less than that of said single dot produced on the print medium by said one drop having a drop weight equal to ($n \cdot W$).

30. A method in accordance with the method of claim 29 wherein said step of directing said majority of droplets further comprises the step of depositing each ink dot from said majority of droplets in as many different pixels as there are nozzles in said one drop generator.

31. A method in accordance with the method of claim 29 wherein said step of directing said majority of droplets further comprises the steps of moving one of said array of drop generators and the print medium relative to one another in a predetermined direction, and depositing each dot from said majority of droplets at a translation angle, $\phi_a$, from said predetermined direction different from each other deposited dot from said majority of droplets.

32. A method in accordance with the method of claim 31 further comprising the steps of:

essentially simultaneously ejecting a droplet of ink having a drop weight ($W_2$) from each nozzle of a second quantity of nozzles equal to ($n_2$) associated with an activation of a second drop generator of a second array of drop generators;

directing a majority of said droplets from said second quantity of nozzles at the print medium to deposit each dot from said majority of droplets from said second quantity of nozzles at a second translation angle, $\phi_b$, from said predetermined direction different from each other deposited dot from said majority of droplets from said second quantity of nozzles; and creating a sum of light absorptions of all said dots deposited on the print medium from said essentially simultaneously ejected droplets of ink from said second drop generator essentially equal to that of a single dot produced on the print medium by one drop having a drop weight equal to ($n_2 \cdot W_2$) but a sum of the light absorptions in any pixel of dots placed on the print medium from said essentially simultaneously ejected droplets of ink from said second drop generator being less than that of said single dot produced on the print medium by said one drop having a drop weight equal to ($n_2 \cdot W_2$).

33. An inkjet printhead having an array of drop generators for ejecting ink to form dots on a print medium, comprising:

a quantity of ink ejecting nozzles equal to (n) and associated with one drop generator of the array of drop generators such that each nozzle of said quantity of ink ejecting nozzles ejects an ink droplet having a drop weight equal to (W) essentially simultaneously when said one drop generator is activated;

said quantity of ink ejecting nozzles arranged to direct droplets ejected during a first activation of said one drop generator toward the print medium to place a majority of dots on the print medium outside a target pixel disposed opposite said one drop generator;

wherein the sum of the light absorptions of all said dots placed on the print medium during said first activation of said one drop generator having a light absorption equal to or greater than that of a single dot produced on the print medium by one drop having a drop weight equal to ($n \cdot W$) but a sum of the light absorptions of dots placed in any pixel on the print medium during said first activation of said one drop generator being less than that of said single dot produced on the print medium by said one drop having a drop weight equal to ($n \cdot W$).

34. The inkjet printhead in accordance with claim 33 wherein said one drop generator further comprises:

an ink ejector; and an orifice plate in which said quantity of ink ejecting nozzles extend from an entrance port adjacent said ink ejector to an exit orifice;

wherein each nozzle of said ink ejecting nozzles has a nozzle axis defining the boresight of said nozzle and wherein a majority of said nozzle axes are tilted away from a perpendicular drawn from a plane of said ink ejector by an ejection angle value whereby each dot formed by a droplet ejected from each tilted nozzle of said ink ejecting nozzles is deposited on the print medium outside said target pixel.

35. The inkjet printhead in accordance with claim 34 wherein one of said inkjet printhead and the print medium are moved relative to one another in a predetermined direction, and wherein each said nozzle axis of said tilted nozzle axes is tilted from said perpendicular to create a dot displaced outside said target pixel by a distance related to said ejection angle at a translation angle, $\phi_a$, from said predetermined direction different from each other tilted nozzle axis.

36. The inkjet printhead in accordance with claim 35 wherein said printhead further comprises:

a second array of drop generators, each including an ink ejector and an orifice plate in which a first plurality of ink ejecting nozzles extend from an entrance port adjacent said ink ejector to an exit orifice, wherein each said nozzle of said second array of drop generators has a nozzle axis defining the boresight of said nozzle and wherein a majority of said nozzle axes are tilted away from a perpendicular drawn from a plane of said ink ejector by an ejection angle value and wherein each nozzle axis of said tilted nozzle axes is tilted from said perpendicular to create a dot displaced outside said target pixel by a distance related to said ejection angle at a second translation angle, $\phi_b$, from said predetermined direction different from each other tilted nozzle axis;

a second quantity of nozzles ($n_2$) associated with one drop generator of said second array of drop generators such that each nozzle of said second quantity of nozzles ejects an ink droplet having a drop weight equal to ($W_2$) essentially simultaneously when said one drop generator of said second array of drop generators is activated;

said second quantity of nozzles arranged to direct each droplet ejected during a first activation of said one drop generator of said second array of drop generators toward the print medium to place a majority of dots on the print medium outside said target pixel; and the sum of the light absorptions of all said dots placed on the print medium during said first activation of said one drop generator of said second array of drop generators having a light absorption equal to or greater than a single dot produced on the print medium by one drop having a drop weight equal to ($n_2 \cdot W_2$) but a sum of the light absorptions of dots placed in any pixel on the print medium during said first activation of said one drop generator of said second array of drop generators being less than said single dot produced on the print medium by said one drop having a drop weight equal to ($n_2 \cdot W_2$).

37. A method of depositing ink dots on a print medium from an inkjet printer comprising the steps of:

essentially simultaneously ejecting a droplet of ink having a drop weight equal to (W) from each nozzle of a quantity of (n) ink ejecting nozzles associated with an activation of one drop generator of an array of drop generators;

directing each said droplet at the print medium to deposit an ink dot having a light absorption on the print medium, a majority of said droplets depositing ink dots outside a target pixel disposed opposite said one drop generator; and creating a sum of light absorptions of all said dots deposited on the print medium from said essentially simultaneously ejected droplets of ink from said one drop generator equal to or greater than that of a single dot produced on the print medium by one drop having a drop weight equal to ($n \cdot W$) but a sum of the light absorptions in any pixel of dots placed on the print medium from said essentially simultaneously ejected droplets of ink from said one drop generator being less than that of said single dot produced on the print medium by said one drop having a drop weight equal to ($n \cdot W$).

38. A method in accordance with the method of claim 37 wherein said step of directing said majority of droplets further comprises the step of depositing each ink dot from said majority of droplets in as many different pixels as there are nozzles in said one drop generator.

39. A method in accordance with the method of claim 37 wherein said step of directing said majority of droplets further comprises the steps of moving one of said array of drop generators and the print medium relative to one another in a predetermined direction, and depositing each dot from said majority of droplets at a translation angle, $\phi a$, from said predetermined direction different from each other deposited dot from said majority of droplets.

40. A method in accordance with the method of claim 39 further comprising the steps of:

essentially simultaneously ejecting a droplet of ink having a drop weight ($W_2$) from each nozzle of a second quantity of nozzles equal to ($n_2$) associated with an activation of a second drop generator of a second array of drop generators;

directing a majority of said droplets from said second quantity of nozzles at the print medium to deposit each dot from said majority of droplets from said second quantity of nozzles at a second translation angle, $\phi_b$, from said predetermined direction different from each other deposited dot from said majority of droplets from said second quantity of nozzles; and creating a sum of light absorptions of all said dots deposited on the print medium from said essentially simultaneously ejected droplets of ink from said second drop generator equal to or greater than that of a single dot produced on the print medium by one drop having a drop weight equal to ($n_2 \cdot W_2$) but a sum of the light absorptions in any pixel of dots placed on the print medium from said essentially simultaneously ejected droplets of ink from said second drop generator being less than that of said single dot produced on the print medium by said one drop having a drop weight equal to ($n_2 \cdot W_2$).

41. An inkjet printer comprising:

a printhead having an array of drop generators for ejecting ink to form dots on a print medium, and including;

a quantity of ink ejecting nozzles equal to (n) and associated with one drop generator of the array of drop generators such that each nozzle of said quantity of ink ejecting nozzles ejects an ink droplet having a drop weight equal to (W) essentially simultaneously when said one drop generator is activated; and said quantity of ink ejecting nozzles arranged to direct droplets ejected during a first activation of said one drop generator toward the print medium to place a majority of dots on the print medium outside a target pixel disposed opposite said one drop generator;

wherein the sum of the light absorptions of all said dots placed on the print medium during said first activation of said one drop generator having a light absorption equal to or greater than that of a single dot produced on the print medium by one drop having a drop weight equal to (n·W) but a sum of the light absorptions of dots placed in any pixel on the print medium during said first activation of said one drop generator being less than that of said single dot produced on the print medium by said one drop having a drop weight equal to (n·W).

42. The inkjet printer in accordance with claim 41 wherein said one drop generator further comprises:

an ink ejector; and an orifice plate in which said quantity of ink ejecting nozzles extend from an entrance port adjacent said ink ejector to an exit orifice;

wherein each nozzle of said ink ejecting nozzles has a nozzle axis defining the boresight of said nozzle and wherein a majority of said nozzle axes are tilted away from a perpendicular drawn from a plane of said ink ejector by an ejection angle value whereby each dot formed by a droplet ejected from each tilted nozzle of said ink ejecting nozzles is deposited on the print medium outside said target pixel.

43. The inkjet printer in accordance with claim 42 wherein one of said inkjet printhead and the print medium are moved relative to one another in a predetermined direction, and wherein each said nozzle axis of said tilted nozzle axes is tilted from said perpendicular to create a dot displaced outside said target pixel by a distance related to said ejection angle at a translation angle, $\phi_a$, from said predetermined direction different from each other tilted nozzle axis.

44. The inkjet printer in accordance with claim 43 further comprising:

a second printhead including;

a second array of drop generators, each including an ink ejector and an orifice plate in which a first plurality of ink ejecting nozzles extend from an entrance port adjacent said ink ejector to an exit orifice, wherein each said nozzle of said second array of drop generators has a nozzle axis defining the boresight of said nozzle and wherein a majority of said nozzle axes are tilted away from a perpendicular drawn from a plane of said ink ejector by an ejection angle value and wherein each nozzle axis of said tilted nozzle axes is tilted from said perpendicular to create a dot displaced outside said target pixel by a distance related to said ejection angle at a second translation angle, $\phi_b$, from said predetermined direction different from each other tilted nozzle axis; and a second quantity of nozzles ($n_2$) associated with one drop generator of said second array of drop generators such that each nozzle of said second quantity of nozzles ejects an ink droplet having a drop weight equal to ($W_2$) essentially simultaneously when said one drop generator of said second array of drop generators is activated, said second quantity of nozzles arranged to direct each droplet ejected during a first activation of said one drop generator of said second array of drop generators toward the print medium to place a majority of dots on the print medium outside said target pixel;

wherein the sum of the light absorptions of all said dots placed on the print medium during said first activation of said one drop generator of said second array of drop generators having a light absorption equal to or greater than a single dot produced on the print medium by one drop having a drop weight equal to ($n_2 \cdot W_2$) but a sum of the light absorptions of dots placed in any pixel on the print medium during said first activation of said one drop generator of said second array of drop generators being less than said single dot produced on the print medium by said one drop having a drop weight equal to ($n_2 \cdot W_2$).

45. A method of depositing ink dots on a print medium from an inkjet printer comprising the steps of:

essentially simultaneously ejecting a droplet of ink from each nozzle of a quantity of (n) ink ejecting nozzles associated with an activation of one drop generator of an array of drop generators, the sum of the drop weights of all droplets ejected from said (n) ink ejecting nozzles equal to ($W_c$);

directing each said droplet at the print medium to deposit an ink dot having a light absorption on the print medium, a majority of said droplets depositing ink dots outside a target pixel disposed opposite said one drop generator; and creating a sum of light absorptions of all said dots deposited on the print medium from said essentially simultaneously ejected droplets of ink from said one drop generator essentially equal to that of a single dot produced on the print medium by one drop having a drop weight equal to ($W_c$) but a sum of the light absorptions in any pixel of dots placed on the print medium from said essentially simultaneously ejected droplets of ink from said one drop generator being less than that of said single dot produced on the print medium by said one drop having a drop weight equal to ($W_c$).

46. A method in accordance with the method of claim 45 wherein said step of directing said majority of droplets further comprises the step of depositing each ink dot from said majority of droplets in as many different pixels as there are nozzles in said one drop generator.

47. A method in accordance with the method of claim 45 wherein said step of directing said majority of droplets further comprises the steps of moving one of said array of drop generators and the print medium relative to one another in a predetermined direction, and depositing each dot from said majority of droplets at a translation angle, $\phi_a$, from said predetermined direction different from each other deposited dot from said majority of droplets.

* * * * *